US010380991B2

(12) United States Patent
Maeno et al.

(10) Patent No.: US 10,380,991 B2
(45) Date of Patent: Aug. 13, 2019

(54) SIGNAL PROCESSING DEVICE, SIGNAL PROCESSING METHOD, AND PROGRAM FOR SELECTABLE SPATIAL CORRECTION OF MULTICHANNEL AUDIO SIGNAL

(71) Applicant: Sony Corporation, Tokyo (JP)

(72) Inventors: Yu Maeno, Tokyo (JP); Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 11 days.

(21) Appl. No.: 15/564,518

(22) PCT Filed: Apr. 1, 2016

(86) PCT No.: PCT/JP2016/060895
§ 371 (c)(1),
(2) Date: Oct. 5, 2017

(87) PCT Pub. No.: WO2016/167138
PCT Pub. Date: Oct. 20, 2016

(65) Prior Publication Data

US 2018/0075837 A1 Mar. 15, 2018

(30) Foreign Application Priority Data

Apr. 13, 2015 (JP) ..... 2015-081608

(51) Int. Cl.
*H04S 7/00* (2006.01)
*G10K 15/12* (2006.01)
(Continued)

(52) U.S. Cl.
CPC ..... *G10K 15/12* (2013.01); *G10K 15/02* (2013.01); *G10K 15/08* (2013.01); *H04R 1/40* (2013.01);
(Continued)

(58) Field of Classification Search
None
See application file for complete search history.

(56) References Cited

U.S. PATENT DOCUMENTS 5,142,586 A 8/1992 Berkhout
2009/0028345 A1* 1/2009 Jung ..... G10L 19/008 381/1
(Continued)

FOREIGN PATENT DOCUMENTS

JP 2-503721 A 11/1990
JP 2010-062700 A 3/2010
JP 2010-193323 A 9/2010

OTHER PUBLICATIONS

International Search Report and Written Opinion and English translation thereof dated May 10, 2016 in connection with International Application No. PCT/JP2016/060895.
(Continued)

*Primary Examiner* — James K Mooney
(74) *Attorney, Agent, or Firm* — Wolf, Greenfield & Sacks, P.C.

(57) ABSTRACT

The present technology relates to a signal processing device, a signal processing method, and a program, which are capable of reproducing an acoustic field more appropriately in accordance with content.
A decoding unit decodes a multiplexed signal, and obtains a multichannel sound collection signal obtained by performing sound collection through a linear microphone array and spatial correction information for selecting a spatial correction scheme for correcting a spatial transfer characteristic. A spatial correction scheme selecting unit selects the spatial correction scheme on the basis of the spatial correction information, and a spatial transfer characteristic matrix generating unit outputs a spatial transfer characteristic matrix indicated by a selection result of the spatial correc-
(Continued)

tion scheme. A drive signal generating unit generates a speaker drive signal of a spatial frequency domain on the basis of the multichannel sound collection signal and the spatial transfer characteristic matrix. The present technology can be applied to a spatial correction controller.

14 Claims, 9 Drawing Sheets

(51) Int. Cl.

| | |
|---|---|
| ***H04R 1/40*** | (2006.01) |
| ***G10K 15/02*** | (2006.01) |
| ***H04R 3/04*** | (2006.01) |
| ***G10K 15/08*** | (2006.01) |
| *G10L 19/008* | (2013.01) |
| *H04R 3/12* | (2006.01) |
| *G10L 21/0216* | (2013.01) |

(52) U.S. Cl.
CPC ..... *H04R 3/04* (2013.01); *H04S 7/307* (2013.01); *G10L 19/008* (2013.01); *G10L 2021/02166* (2013.01); *H04R 1/406* (2013.01); *H04R 3/12* (2013.01); *H04R 2201/403* (2013.01); *H04S 2420/01* (2013.01)

(56) References Cited

U.S. PATENT DOCUMENTS

| | | | | |
|---|---|---|---|---|
| 2011/0194700 | A1* | 8/2011 | Hetherington ..... | H04M 3/568 381/17 |
| 2015/0170629 | A1* | 6/2015 | Christoph ..... | G10H 5/00 381/61 |
| 2016/0163303 | A1* | 6/2016 | Benattar ..... | G10K 11/175 381/71.11 |

OTHER PUBLICATIONS

International Preliminary Report on Patentability and English translation thereof dated Oct. 26, 2017 in connection with International Application No. PCT/JP2016/060895.

Ahrens et al., Applying the Ambisonics Approach on Planar and Linear Arrays of Loudspeakers, Proc. of the 2nd International Symposium on Ambisonics and Spherical Acoustics, May 6-7, 2010, Paris, France, 6 pages.

Kamado et al., Sound Field Reproduction by Wavefront Synthesis Using Directly Aligned Multi Point Control, AES 40$^{th}$ International Conference, Tokyo, Japan, 2010, Oct. 8-10, 9 pages.

* cited by examiner

FIG.5

| CORRECTION ELEMENT | $G_{ideal}'(n_{tf})$ | $G_{diag}'(n_{tf})$ | $G_{tridiag}'(n_{tf})$ | $G_{block}'(n_{tf})$ | $G_{all}'(n_{tf})$ |
|---|---|---|---|---|---|
| SPEAKER CHARACTERISTIC | × | ○ | ○ | ○ | ○ |
| REFLECTION FROM WALL PARALLEL TO LINEAR SPEAKER ARRAY DIRECTION | × | ○ | ○ | ○ | ○ |
| REVERBERATION | × | △ | △ | △ | ○ |
| REFLECTION FROM WALL NOT PARALLEL TO LINEAR SPEAKER ARRAY DIRECTION | × | × | × | × | ○ |

SIGNAL PROCESSING DEVICE, SIGNAL PROCESSING METHOD, AND PROGRAM FOR SELECTABLE SPATIAL CORRECTION OF MULTICHANNEL AUDIO SIGNAL

CROSS-REFERENCE TO RELATED APPLICATIONS

This application is a National Stage of International Application No. PCT/JP2016/060895, filed in the Japanese Patent Office as a Receiving office on Apr. 1, 2016, which claims priority to Japanese Patent Application Number 2015-081608, filed in the Japanese Patent Office on Apr. 13, 2015, each of which is hereby incorporated by reference in its entirety.

TECHNICAL FIELD

The present technology relates to a signal processing device, a signal processing method, and a program, and more particularly, to a signal processing device, a signal processing method, and a program which are capable of reproducing an acoustic field more appropriately in accordance with content.

BACKGROUND ART

In the past, a technique of acquiring and transmitting an audio signal of a certain space using a large-scale microphone array and reproducing the same acoustic field in another space using a large speaker array has been introduced.

As a technique related to such acoustic field reproduction, a technique of reducing an operation amount when a speaker drive signal for outputting a sound through a speaker array is calculated by performing spatial frequency transform and diagonalizing a transfer function matrix has been proposed (for example, see Non-Patent Literature 1).

However, in a case in which the acoustic field reproduction is performed, if a sound that is not in an audio signal transmission source, that is, a sound collection space, such as a reflected sound in a wall, a ceiling, or the like, a reverberant sound, or the like occurs in a reproduction space in which an acoustic field is reproduced, spatial reproducibility of the acoustic field decreases, and a sense of presence is impaired. In the technique described in Non-Patent Literature 1, since an ideal spatial transfer characteristic in a free space is premised, the spatial reproducibility of the acoustic field may sometimes decrease depending on a reproduction environment.

The decrease in the spatial reproducibility of the acoustic field can be suppressed by measuring a spatial transfer characteristic of a sound including reflection and reverberation in a reproduction space and carrying out a spatial correction process.

As such a technique, for example, a technique of using an actual spatial transfer characteristic for a calculation of a speaker drive signal in acoustic field reproduction using a speaker array has been proposed (for example, see Non-Patent Literature 2). In this technique, the speaker drive signal is calculated by performing a time frequency transform on a measured spatial transfer characteristic from each speaker to an observation point (control point) and calculating a pseudo inverse matrix of a spatial transfer characteristic matrix for each time frequency.

CITATION LIST

Patent Literature

Non-Patent Literature

Non-Patent Literature 1: Jens Adrens, Sascha Spors, "Applying the Ambisonics Approach on Planar and Linear Arrays of Loudspeakers," in 2nd International Symposium on Ambisonics and Spherical Acoustics.

Non-Patent Literature 2: N. Kamado, H. Hokari, S. Shimada, H. Saruwatari, and K. Shikano, "Sound field reproduction by wavefront synthesis using directly aligned multi point control," in Proc. 40-th Conf. AES, Tokyo, October 2010.

DISCLOSURE OF INVENTION

Technical Problem

However, in the technique described in Non-Patent Literature 2, in order to obtain the speaker drive signal, it is necessary to consistently perform a matrix operation using all elements of the spatial transfer characteristic matrix for each time frequency, and thus the operation amount increases. Particularly, more operations are required in a large-scale system having a large number of channels.

In this case, on the reproduction space side, it is necessary to allocate many operation resources to the operation for the speaker drive signal, that is, an operation for the spatial correction process, and operation resources that can be allocated to other processes such as a sound quality improvement process are reduced.

Depending on the acoustic field to be reproduced, that is, content to be reproduced, for example, a content creator or a content listener may want to emphasize the sound quality reproducibility as well as the spatial reproducibility. For this reason, it is desired to provide a technology which is capable of allocating the operation resources in accordance with content to be reproduced and reproducing the acoustic field more appropriately.

The present technology was made in light of the foregoing, and it is desirable to reproduce the acoustic field more appropriately in accordance with content.

Solution to Problem

A signal processing device according to a first aspect of the present technology includes: an acquiring unit configured to acquire a multichannel audio signal obtained by performing sound collection through a microphone array; a spatial correction scheme selecting unit configured to select one spatial correction scheme from among a plurality of spatial correction schemes for correcting a spatial transfer characteristic on the basis of spatial correction information; and a spatial correction processing unit configured to perform a spatial correction process on the audio signal on the basis of a spatial transfer characteristic matrix of the selected spatial correction scheme.

The spatial correction information can be caused to be information indicating a priority of the spatial correction process.

The spatial correction scheme selecting unit can be caused to select the spatial correction scheme on the basis of the spatial correction information and a number of speakers constituting a speaker array that outputs a sound on the basis of the audio signal.

The spatial correction scheme selecting unit can be caused to select the spatial correction scheme on the basis of the spatial correction information and an operation capability of the signal processing device.

The plurality of spatial correction schemes can be caused to differ from each other in an operation amount of the spatial correction process.

The spatial transfer characteristic matrix can be caused to be obtained by extracting a part or a whole of a matrix indicating a spatial transfer characteristic of a space in which a sound based on the audio signal is reproduced.

The spatial transfer characteristic matrices of the plurality of spatial correction schemes can be caused to include at least any one of the spatial transfer characteristic matrix obtained by extracting at least only a diagonal component of the matrix, the spatial transfer characteristic matrix obtained by extracting only a triple diagonal component of the matrix, the spatial transfer characteristic matrix obtained by extracting only a specific block of the matrix, and the spatial transfer characteristic matrix which is the matrix.

The spatial correction information can be caused to be set in the audio signal in a predetermined time unit.

The acquiring unit can be caused to acquire the spatial correction information together with the audio signal.

A signal processing method or a program according to the first aspect of the present technology includes the steps of: acquiring a multichannel audio signal obtained by performing sound collection through a microphone array; selecting one spatial correction scheme from among a plurality of spatial correction schemes for correcting a spatial transfer characteristic on the basis of spatial correction information; and performing a spatial correction process on the audio signal on the basis of a spatial transfer characteristic matrix of the selected spatial correction scheme.

According to the first aspect of the present technology, a multichannel audio signal obtained by performing sound collection through a microphone array is acquired, one spatial correction scheme is selected from among a plurality of spatial correction schemes for correcting a spatial transfer characteristic on the basis of spatial correction information, and a spatial correction process is performed on the audio signal on the basis of a spatial transfer characteristic matrix of the selected spatial correction scheme.

A signal processing device according to a second aspect of the present technology includes: an acquiring unit configured to acquire spatial correction information for selecting a scheme of a spatial correction process of correcting a spatial transfer characteristic, the spatial correction process being performed on a multichannel audio signal obtained by performing sound collection through a microphone array; and an output unit configured to output the audio signal and the spatial correction information.

The spatial correction information can be caused to be information indicating a priority of the spatial correction process.

The spatial correction information can be caused to be set in the audio signal in a predetermined time unit.

A signal processing method or a program according to the second aspect of the present technology includes the steps of: acquiring spatial correction information for selecting a scheme of a spatial correction process of correcting a spatial transfer characteristic, the spatial correction process being performed on a multichannel audio signal obtained by performing sound collection through a microphone array; and outputting the audio signal and the spatial correction information.

According to the second aspect of the present technology, spatial correction information for selecting a scheme of a spatial correction process of correcting a spatial transfer characteristic, the spatial correction process being performed on a multichannel audio signal obtained by performing sound collection through a microphone array is acquired, and the audio signal and the spatial correction information are output.

Advantageous Effects of Invention

According to the first and second aspects of the present technology, it is possible to reproduce the acoustic field more appropriately in accordance with content.

Further, the effects described herein are not necessarily limited, and any effect described in the present disclosure may be included.

BRIEF DESCRIPTION OF DRAWINGS

FIG. 5 is a diagram for describing a spatial transfer characteristic matrix.

MODE(S) FOR CARRYING OUT THE INVENTION

Hereinafter, embodiments to which the present technology is applied will be described with reference to the accompanying drawings.

First Embodiment

<Present Technology>

In the present technology, an acoustic field is recorded through a microphone array including a plurality of microphones in a real space (sound collection space), and the acoustic field is reproduced through a speaker array including a plurality of speakers arranged in a reproduction space on the basis of a multichannel sound collection signal obtained as a result.

As described above, if a sound that is not in the sound collection space such as a reflected sound, a reverberant sound, or the like occurs in the reproduction space, the spatial reproducibility of the acoustic field decreases, and a sense of presence is impaired, and thus the spatial correction process of correcting the spatial transfer characteristic is performed in the reproduction space.

However, as the number of channels for reproducing a sound, that is, a system scale increases, the operation amount for the spatial correction process also increases, and the operation resources that can be allocated to other processes decrease accordingly.

Figure 1:
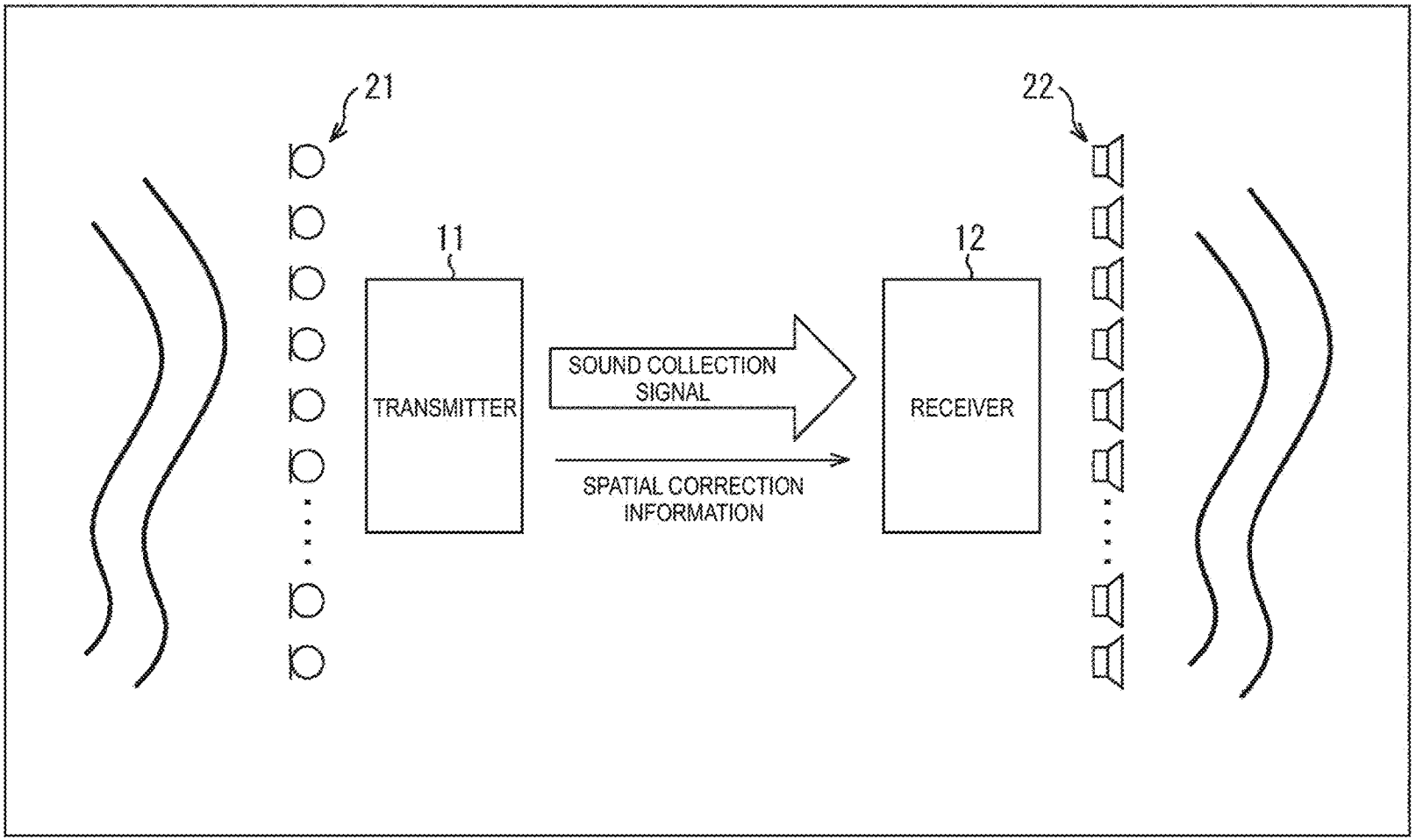
FIG. 1 is a diagram for describing the present technology.

In this regard, in the present technology, as illustrated in FIG. 1, a degree of necessity of the spatial correction process in content to be reproduced, that is, spatial correction information fig indicating a priority of the spatial correction process, is also transmitted to the reproduction space side together with the sound collection signal obtained by collecting the acoustic field.

In FIG. 1, a transmitter 11 functioning as an encoding device is arranged in the sound collection space, and a receiver 12 functioning as a decoding device is arranged in the reproduction space.

The transmitter 11 includes a linear microphone array 21 configured with a plurality of linearly arranged microphones, and a sound (acoustic field) of the sound collection space is collected as content through the linear microphone array 21. Further, the transmitter 11 records the spatial correction information flg input by the content creator or the like for each piece of content.

Here, the spatial correction information flg indicates a degree to which the operation resources have to be concentrated in the spatial correction process, that is, the priority of the spatial correction process in the entire process for reproducing the content, and as a value of the spatial correction information flg increases, the priority increases. In other words, it indicates that as the value of the spatial correction information flg increases, a spatial correction process of a spatial correction scheme with a greater operation amount has to be performed to improve the spatial reproducibility of the content.

For example, the value of the spatial correction information flg allocated by the content creator or the like may be defined by a discrete value such as four steps of 0 to 3 or may be defined by a continuous value.

For example, in a case in which the spatial correction information flg is defined by the discrete value, the value of the spatial correction information flg may be set to 0 when it is not necessary to perform the spatial correction, 1 when it is necessary to correct the speaker characteristic and the spatial transfer characteristic of the direct sound, 2 when it is necessary to correct initial reflection from a wall parallel to the speaker array such as a ceiling or a floor, and 3 when it is necessary to correct reflection from the left and right walls perpendicular to the speaker array or the like. Further, the spatial correction information flg may be defined on the basis of the priority of the sound quality reproducibility.

The following description will proceed with an example in which the spatial correction information flg is a value indicating the priority of the spatial correction process, but the spatial correction information flg may be any information as long as the information functions as an index for selecting a spatial correction process scheme, that is, a spatial correction scheme. Further, the spatial correction information flg may be the spatial transfer characteristic matrix used for the spatial correction process.

The transmitter 11 transmits a sound collection signal of content obtained by sound collection and the spatial correction information flg of the content to the receiver 12.

Meanwhile, the receiver 12 arranged in the reproduction space has a linear speaker array 22 configured with a plurality of linearly arranged speakers.

Upon receiving the sound collection signal and the spatial correction information flg transmitted from the transmitter 11, the receiver 12 performs the spatial correction process of the spatial correction scheme corresponding to the spatial correction information flg on the sound collection signal and outputs the sound through the linear speaker array 22 on the basis of a speaker drive signal obtained as a result. Accordingly, the acoustic field of the sound collection space is reproduced. In other words, the content is reproduced.

If the spatial correction information flg is transmitted together with the sound collection signal in this manner, it is possible to select a spatial correction process of an optimal scheme in accordance with the content in a stepwise manner and adjust the operation amount of the spatial correction process.

At this time, if the spatial correction information flg is set for the content (the sound collection signal) in predetermined time units and transmitted, it is possible to adjust the operation amount by switching the spatial correction process scheme in the predetermined time units. Accordingly, more appropriate acoustic field reproduction can be realized in accordance with the content, a content scene, or the like.

The predetermined time unit may be any fixed or variable time interval such as each piece of content, each content scene, each transmission frame of the sound collection signal, or the like.

For example, in a case in which the spatial correction information flg is switched in units of content, the spatial correction information flg is switched in accordance with channel switching of a television program, and thus the spatial correction process of the optimal spatial correction scheme is performed for each television program.

In a case in which the spatial correction information flg is transmitted to the reproduction side together with the content as described above, the transmitter 11 has an advantage in that it is possible to transmit an intention of the content creator in the acoustic field reproduction to the reproduction side using the spatial correction information flg.

The receiver 12 side has an advantage in that it is possible to adjust the operation amount of the spatial correction process in view of the operation resources of the receiver 12 as well as the content and reproduce the acoustic field more appropriately.

Figure 2:
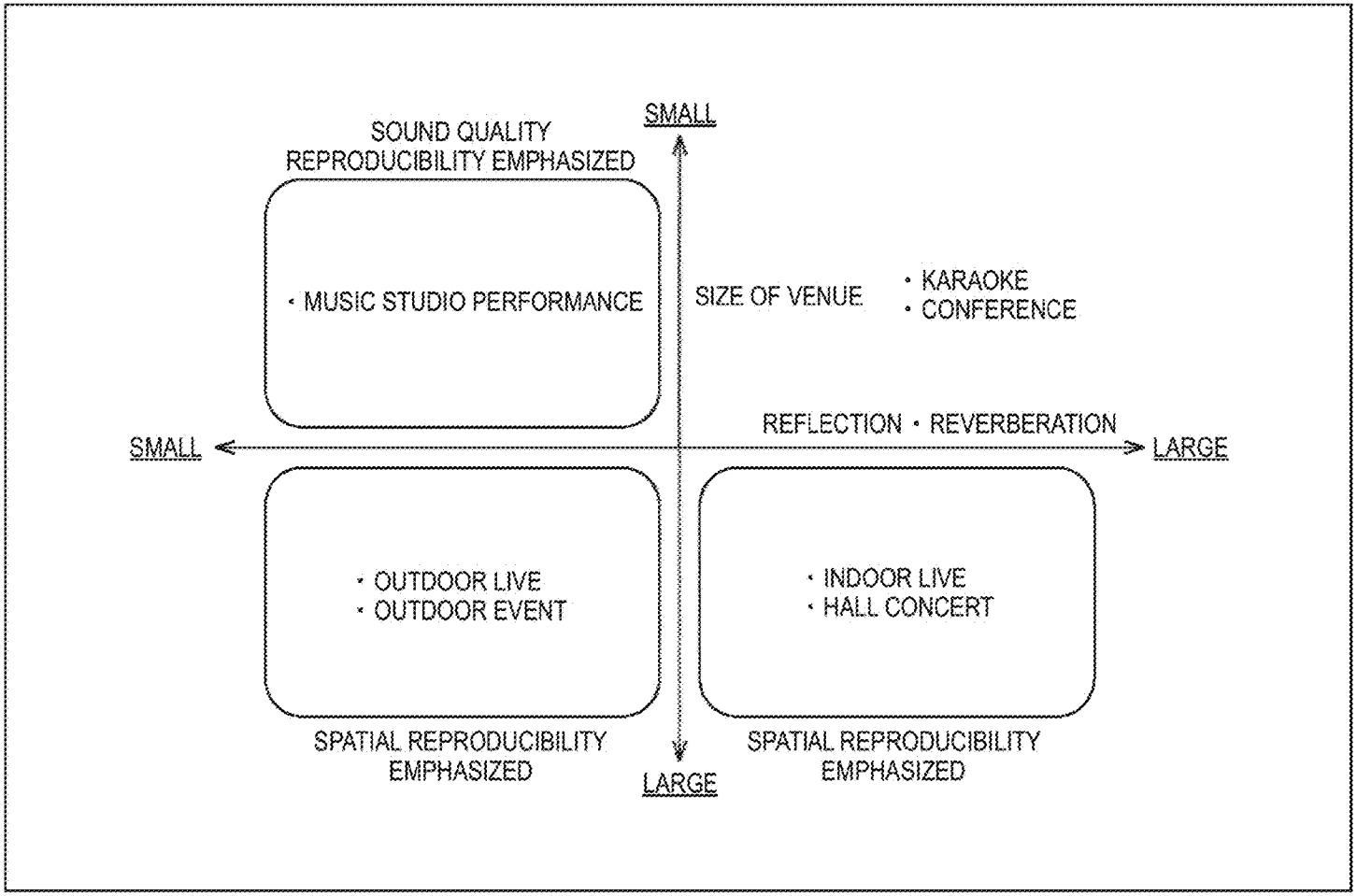
FIG. 2 is a diagram for describing spatial correction information.

Here, as an example, a case of classifying the content to be transmitted in accordance with two axes including a size of a venue and a magnitude of reflection or reverberation as illustrated in FIG. 2 is considered.

In FIG. 2, a vertical axis indicates the size of the venue in which the acoustic field serving as the content is collected, that is, the size of the sound collection space, and in FIG. 2, the sizes of the venues increase downward. Further, in FIG. 2, a horizontal axis indicates the magnitude of the reflection or reverberation in the venue in which the content is collected, and in FIG. 2, the magnitude of the reflection or the reverberation increases to the right.

Here, the content creator is assumed to designate his/her intention indicating whether importance is given to the sound quality at the time of content reproduced or the spatial reproducibility such as the reflection or the reverberation.

For example, in the case of content in which the venue (sound collection space) is large such as an outdoor or indoor live performance, when the acoustic field is reproduced in the reproduction space regardless of the magnitude of the reflection or the reverberation of the sound in the venue, a sense of the original size of the venue is not transferred due to influence of the reflection or the reverberation of the sound in the reproduction space, and a sense of presence is impaired.

In this regard, allocating the spatial correction information flg emphasizing the spatial reproducibility at the time of content reproduction to content collected in a large venue such as an outdoor live performance, an outdoor event, an indoor live performance, or a hall concert by the content creator is considered. In this regard, the receiver 12 side is able to concentrate the operation resources on the spatial correction process and reproduce the content in accordance with the intention of the content creator with the high spatial reproducibility.

On the other hand, in the case of content collected in a small venue such as a music studio performance, influence of the reflection or the reverberation of the sound in the reproduction space is not so large. In this regard, allocating the spatial correction information flg not emphasizing the spatial reproducibility at the time of content reproduction to the content by the content creator is considered.

In this case, in the receiver 12, the operation resources necessary for the spatial correction process are few, and thus it is possible to improve the sound quality reproducibility by concentrating the operation resources on the sound quality improvement process accordingly and allocate more operation resources to other processes.

Further, it is desirable for the content creator to allocate the spatial correction information flg to content in which a venue is small, and the reflection or the reverberation is large such as a karaoke or a conference in view of a balance between the spatial reproducibility and the sound quality reproducibility.

According to the present technology described above, the content creator is able to transmit the spatial correction information flg indicating the priority of the spatial correction process to the reproduction side and reflect his/her intention of emphasizing the sound quality reproducibility or the spatial reproducibility in accordance with the content.

Particularly, since the spatial correction information flg can be designated in predetermined time units, in a case in which the priority of the spatial correction process is low, the receiver 12 is able to allocate the operation resources to other processes and thus implement the acoustic field reproduction with a higher degree of freedom.

Further, in the present technology, it is possible to perform the spatial correction process in view of the operation resources of the receiver 12 as well. Specifically, for example, it is desirable for the receiver 12 to select the spatial correction process scheme on the basis of the spatial correction information flg and the operation resources of the receiver 12.

<Configuration Example of Spatial Correction Controller>

Next, a more specific example to which the present technology is applied will be described with an example in which the present technology is applied to a spatial correction controller.

Figure 3:
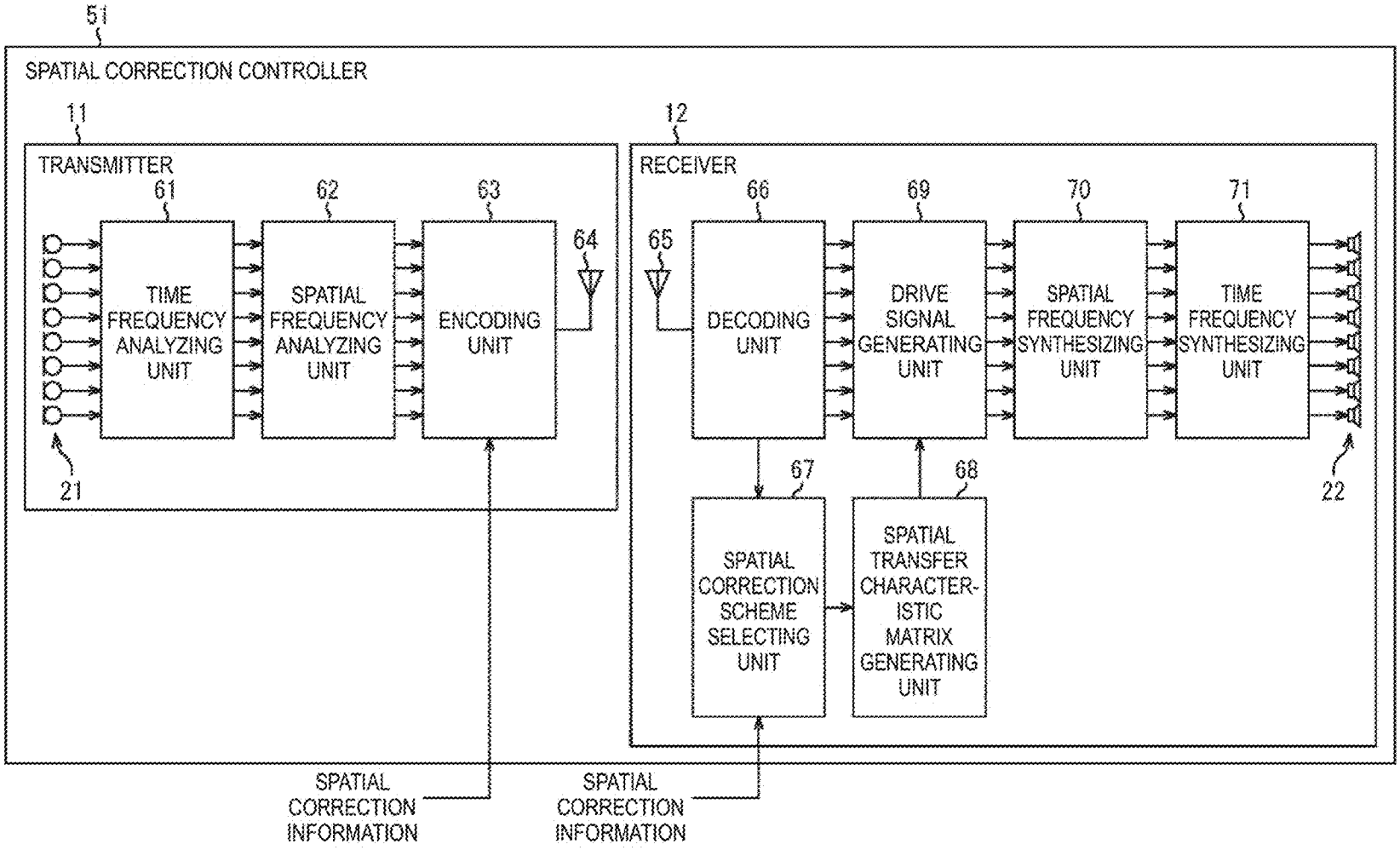
FIG. 3 is a diagram illustrating a configuration example of a spatial correction controller.

FIG. 3 is a diagram illustrating a configuration example of one embodiment of a spatial correction controller to which the present technology is applied. In FIG. 3, parts corresponding to those in FIG. 1 are denoted by the same reference numerals, and description thereof will be appropriately omitted.

A spatial correction controller 51 has a transmitter 11 arranged in a sound collection space and a receiver 12 arranged in a reproduction space. The transmitter 11 is a signal processing device functioning as an encoding device, and the receiver 12 is a signal processing device functioning as a decoding device.

The transmitter 11 includes a linear microphone array 21, a time frequency analyzing unit 61, a spatial frequency analyzing unit 62, an encoding unit 63, and a communication unit 64.

The linear microphone array 21 collects the sound of the sound collection space as the content and supplies the sound collection signal which is a multichannel audio signal obtained as a result to the time frequency analyzing unit 61.

The time frequency analyzing unit 61 performs a time frequency transform on the sound collection signal supplied from the linear microphone array 21 and supplies a time frequency spectrum obtained as a result to the spatial frequency analyzing unit 62. The spatial frequency analyzing unit 62 performs a spatial frequency transform on the time frequency spectrum supplied from the time frequency analyzing unit 61 and supplies a spatial frequency spectrum obtained as a result to the encoding unit 63.

The encoding unit 63 encodes the spatial frequency spectrum supplied from the spatial frequency analyzing unit 62 and the spatial correction information fig input by the content creator or the like and supplies a multiplexed signal obtained as a result to the communication unit 64. The communication unit 64 transmits the multiplexed signal supplied from the encoding unit 63 to the receiver 12 in a wired or wireless manner.

The receiver 12 includes a communication unit 65, a decoding unit 66, a spatial correction scheme selecting unit 67, a spatial transfer characteristic matrix generating unit 68, a drive signal generating unit 69, a spatial frequency synthesizing unit 70, a time frequency synthesizing unit 71, and a linear speaker array 22.

The communication unit 65 receives the multiplexed signal transmitted from the communication unit 64 and supplies it to the decoding unit 66. The decoding unit 66 extracts the spatial frequency spectrum and the spatial correction information flg from the multiplexed signal by decoding the multiplexed signal supplied from the communication unit 65. The decoding unit 66 supplies the spatial correction information flg obtained by the decoding to the spatial correction scheme selecting unit 67 and supplies the spatial frequency spectrum obtained by the decoding to the drive signal generating unit 69.

The spatial correction scheme selecting unit 67 selects the spatial correction process scheme (the spatial correction scheme) performed when the speaker drive signal for reproducing sound through the linear speaker array 22 is calculated from the spatial frequency spectrum of the sound collection signal on the basis of the spatial correction information flg supplied from the decoding unit 66, and supplies a selection result to the spatial transfer characteristic matrix generating unit 68.

The spatial transfer characteristic matrix generating unit 68 supplies a spatial transfer characteristic matrix indicating a spatial transfer characteristic corresponding to the selection result of the spatial correction scheme supplied from the spatial correction scheme selecting unit 67 to the drive signal generating unit 69.

The drive signal generating unit 69 performs the spatial correction process on the basis of the spatial frequency spectrum supplied from the decoding unit 66 and the spatial transfer characteristic matrix supplied from the spatial transfer characteristic matrix generating unit 68, generates a speaker drive signal of a spatial frequency domain for reproducing the collected acoustic field at the same time, and supplies the speaker drive signal to the spatial frequency synthesizing unit 70.

The spatial frequency synthesizing unit 70 performs spatial frequency synthesis on the spatial frequency spectrum which is the speaker drive signal of the spatial frequency domain supplied from the drive signal generating unit 69, and supplies a time frequency spectrum obtained as a result to the time frequency synthesizing unit 71.

The time frequency synthesizing unit 71 performs time frequency synthesis on the time frequency spectrum supplied from the spatial frequency synthesizing unit 70, and supplies the speaker drive signal which is a time signal obtained as a result to the linear speaker array 22. The linear speaker array 22 reproduces the sound on the basis of the speaker drive signal supplied from the time frequency synthesizing unit 71. Accordingly, the acoustic field is reproduced in the sound collection space.

Here, an example in which the linear microphone array 21 is used as a microphone array that collects the sound in the sound collection space is described, but the sound may be collected by any other microphone array such as a spherical microphone array or an annular microphone array as long as it includes a plurality of microphones.

Similarly, an example in which the linear speaker array 22 is used as the speaker array is described, but any other speaker array such as a spherical speaker array or an annular speaker array may be used as a speaker array that reproduces the sound as long as it includes a plurality of speakers.

Next, the components constituting the spatial correction controller 51 will be described in further detail.

(Time Frequency Analyzing Unit)

The time frequency analyzing unit 61 performs the time frequency transform on a multichannel sound collection signal $s(i,n_t)$ obtained by collecting the sounds through the microphones constituting the linear microphone array 21. In other words, the time frequency analyzing unit 61 performs the time frequency transform using a discrete Fourier transform (DFT) by performing a calculation of the following Formula (1), and obtains a time frequency spectrum $S(i,n_{tf})$ from the sound collection signal $s(i,n_t)$.

[Math. 1]

$$S(i, n_{tf}) = \sum_{n_t=0}^{M_t-1} s(i, n_t) e^{-j\frac{2\pi n_{tf} n_t}{M_t}} \tag{1}$$

In Formula (1), i represents a microphone index identifying a microphone constituting the linear microphone array 21, for example, the microphone index $i=0, 1, 2, \ldots, N_m-1$. Further, $N_m$ indicates the number of microphones constituting the linear microphone array 21, and $n_t$ indicates a time index.

Furthermore, in Formula (1), $n_{tf}$ indicates a time frequency index, $M_t$ indicates the number of samples of the DFT, and j indicates a pure imaginary number.

The time frequency analyzing unit 61 supplies the time frequency spectrum $S(i,n_{tf})$ obtained by the time frequency transform to the spatial frequency analyzing unit 62.

(Spatial Frequency Analyzing Unit)

The spatial frequency analyzing unit 62 performs the spatial frequency transform on the time frequency spectrum $S(i,n_{tf})$ supplied from the time frequency analyzing unit 61. In other words, the spatial frequency analyzing unit 62 performs the spatial frequency transform using an inverse discrete Fourier transform (IDFT) by performing a calculation of the following Formula (2), and obtains a spatial frequency spectrum $S_{SP}(n_{tf},n_{sf})$ from the time frequency spectrum $S(i,n_{tf})$.

[Math. 2]

$$S_{SP}(n_{tf}, n_{sf}) = \frac{1}{M_s} \sum_{i=0}^{M_s-1} S(i, n_{tf}) e^{j\frac{2\pi n_{sf} i}{M_s}} \tag{2}$$

In Formula (2), $n_{sf}$ indicates a spatial frequency index, and $M_s$ indicates the number of samples of the IDFT. Further, j indicates a pure imaginary number. The spatial frequency analyzing unit 62 supplies the spatial frequency spectrum $S_{SP}(n_{tf},n_{sf})$ obtained by the spatial frequency transform to the encoding unit 63.

(Encoding Unit)

The encoding unit 63 acquires the spatial correction information flg input by the content creator or the like. Then, the encoding unit 63 encodes the obtained spatial correction information flg and the spatial frequency spectrum $S_{SP}(n_{tf},n_{sf})$ supplied from the spatial frequency analyzing unit 62, and generates a multiplexed signal obtained by multiplexing the spatial frequency spectrum $S_{SP}(n_{tf},n_{sf})$ and the spatial correction information flg. The multiplexed signal obtained by the encoding unit 63 is output through the communication unit 64 and then acquired by the decoding unit 66 via the communication unit 65.

Here, the example of transmitting the spatial frequency spectrum of the sound collection signal to the receiver 12 is described, but the time frequency spectrum of the sound collection signal may be transmitted to the receiver 12. In a case in which the spatial frequency spectrum is transmitted, it is possible to preferentially allocate bits to a time frequency band and a spatial frequency band which are important for the acoustic field reproduction, and thus it is possible to compress information more than in a case in which the time frequency spectrum is transmitted.

(Decoding Unit)

The decoding unit 66 acquires the multiplexed signal from the encoding unit 63 via the communication unit 65 and the communication unit 64. The decoding unit 66 decodes the acquired multiplexed signal and extracts the spatial frequency spectrum $S_{SP}(n_{tf},n_{sf})$ and the spatial correction information flg from the multiplexed signal. The decoding unit 66 supplies the obtained spatial frequency spectrum $S_{SP}(n_{tf},n_{sf})$ to the drive signal generating unit 69, and supplies the spatial correction information fig to the spatial correction scheme selecting unit 67.

(Spatial Transfer Characteristic Matrix Generating Unit)

The spatial transfer characteristic matrix generating unit 68 supplies the spatial transfer characteristic matrix corresponding to the selection result of the spatial correction scheme supplied from the spatial correction scheme selecting unit 67 to the drive signal generating unit 69.

Here, the spatial transfer characteristic matrix may be generated in advance and stored in the spatial transfer characteristic matrix generating unit 68 or may be generated by the spatial transfer characteristic matrix generating unit 68 after the spatial correction scheme is selected. The following description will proceed with an example in which a spatial transfer characteristic matrix is generated in advance.

The spatial transfer characteristic matrix generating unit 68 generates a spatial transfer characteristic matrix $G_{ideal}'(n_{tf})$, a spatial transfer characteristic matrix $G_{diag}'(n_{tf})$, a spatial transfer characteristic matrix $G_{tridiag}'(n_{tf})$, a spatial transfer characteristic matrix $G_{block}'(n_{tf})$, and a spatial transfer characteristic matrix $G_{all}'(n_{tf})$ as the spatial transfer characteristic matrices for performing the spatial correction process.

Figure 4:
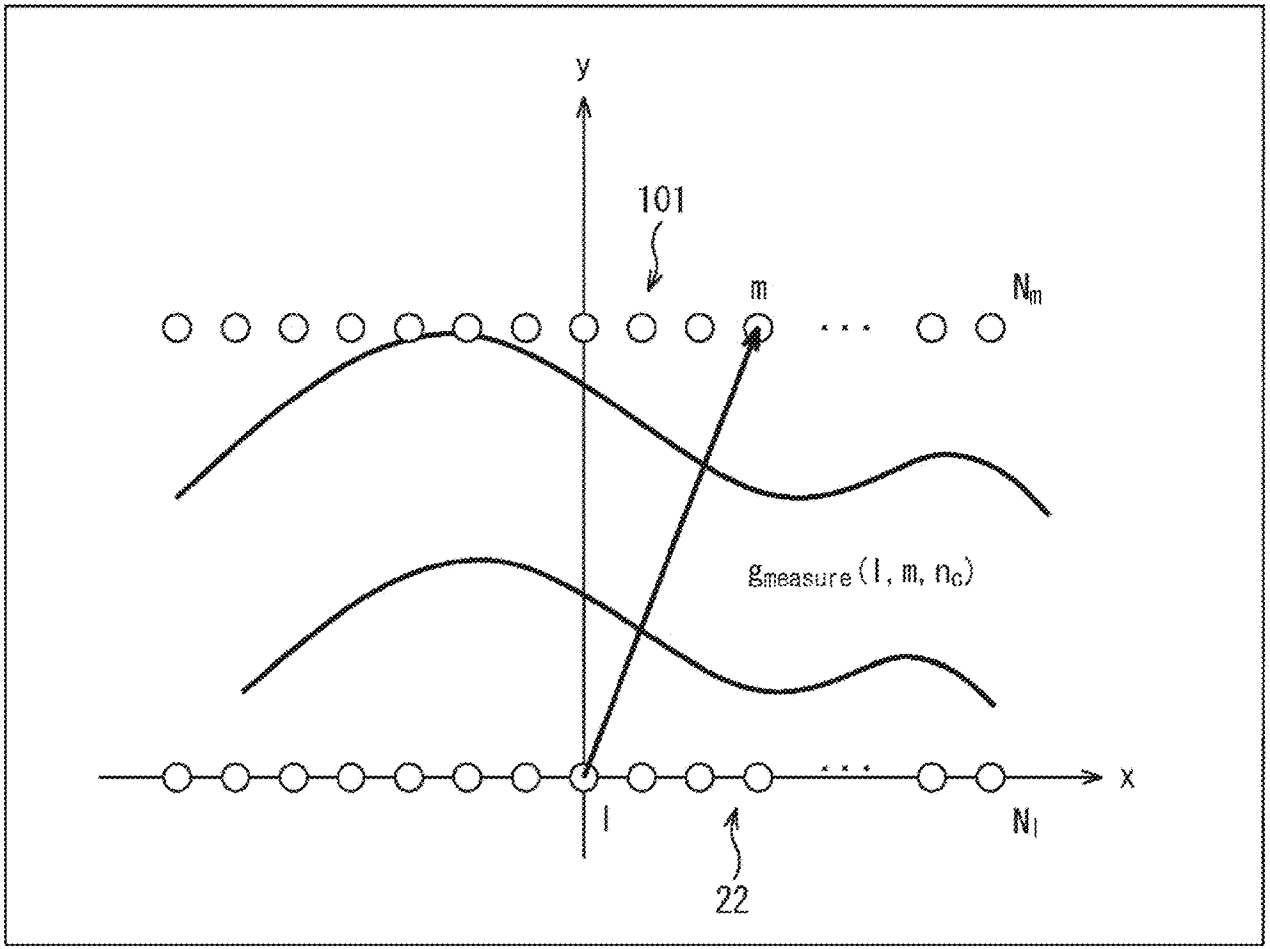
FIG. 4 is a diagram for describing measurement of a spatial transfer characteristic.

For example, as illustrated in FIG. 4, the linear speaker array 22 is assumed to be arranged in the reproduction space, and a linear microphone array 101 for spatial transfer characteristic measurement corresponding to the linear microphone array 21 is assumed to be arranged at a position a predetermined distance away from the linear speaker array 22.

Further, a direction in which the microphones constituting the linear microphone array 101 and the speakers constituting the linear speaker array 22 are arranged linearly is referred to as an x-axis direction, a direction perpendicular to the x-axis direction is referred to as a y-axis direction, and an xy coordinate system whose origin is a position of a speaker at the center of the linear speaker array 22 is assumed to be used.

Here, the linear speaker array 22 is assumed to be configured with $N_1$ speakers, and a speaker index identifying each speaker is indicated by 1 ($1=0, 1, 2, \ldots, N_1-1$). Further, the linear microphone array 101 is assumed to be configured with $N_m$ microphones, and a microphone index identifying each microphone is m ($m=0, 1, 2, \ldots, N_m-1$).

At this time, the spatial transfer characteristic from the speaker of each speaker index 1 to the microphone of each microphone index m is actually measured, and a time signal $g_{measure}(l,m,n_c)$ indicating the spatial transfer characteristic obtained as a result is appropriately used for generation of the spatial transfer characteristic matrix in the spatial transfer characteristic matrix generating unit 68. l, m, and $n_c$ in the time signal $g_{measure}(l,m,n_c)$ indicate the speaker index 1, the microphone index m, and the time index $n_c$, respectively.

In the case in which the xy coordinate system is used, the spatial transfer characteristic matrix generating unit 68 obtains the spatial transfer characteristic matrix $G_{ideal}'(n_{tf})$ in the spatial frequency domain by calculating the following Formula (3).

[Math. 3]

$$G'_{ideal}(n_{tf}) = \begin{cases} -\frac{j}{4}H_0^{(2)}\left(\sqrt{\left(\frac{\omega}{c}\right)^2 - k_x^2}\cdot y\right), \text{ for } 0 \le |k_x| < \left|\frac{\omega}{c}\right| \\ \frac{1}{2\pi}K_0\left(\sqrt{k_x^2 - \left(\frac{\omega}{c}\right)^2}\cdot y\right), \text{ for } 0 < \left|\frac{\omega}{c}\right| < |k_x| \end{cases} \tag{3}$$

In Formula (3), j indicates a pure imaginary number, $k_x$ indicates a spatial frequency in the x-axis direction, ω indicates a time angular frequency, and c indicates a sound speed.

Further, y indicates a distance between the linear microphone array 101 and the linear speaker array 22 in the y-axis direction, $H_0^{(2)}$ indicates a zero-order second-class Hankel function, and $K_0$ indicates a zero-order second-class Bessel function.

The spatial transfer characteristic matrix $G_{ideal}'(n_{tf})$ calculated as described above is a matrix having a spatial frequency spectrum indicating an ideal spatial transfer characteristic from each of the speakers constituting the linear speaker array 22 to each of the microphones constituting the linear microphone array 101 as an element. Therefore, the spatial transfer characteristic matrix $G_{ideal}'(n_{tf})$ is used as the spatial transfer characteristic matrix when the spatial correction process is not substantially performed, that is, when correction of the spatial transfer characteristic is not substantially performed in the spatial correction process.

Further, the spatial transfer characteristic matrix generating unit 68 uses the time signal $g_{measure}(l,m,n_c)$ obtained by actual measurement in a case in which the spatial transfer characteristic matrix $G_{diag}'(n_{tf})$, the spatial transfer characteristic matrix $G_{tridiag}'(n_{tf})$, the spatial transfer characteristic matrix $G_{block}'(n_{tf})$, and the spatial transfer characteristic matrix $G_{all}'(n_{tf})$ are calculated.

First, if the time signal $g_{measure}(l,m,n_c)$ is supplied, the spatial transfer characteristic matrix generating unit 68 performs the time frequency transform on the time signal $g_{measure}(l,m,n_c)$ and obtains the time frequency spectrum $G_{measure}(l,m,n_{tf})$ of the spatial transfer characteristic.

Here, the time frequency transform performed by the spatial transfer characteristic matrix generating unit 68 is the same transform as the time frequency transform performed in the time frequency analyzing unit 61, and a time sampling rate of the time signal $g_{measure}(l,m,n_c)$ is assumed to be equal to the time sampling rate of the sound collection signal $s(i,n_t)$. Further, $n_{tf}$ in the time frequency spectrum $G_{measure}(l,m,n_{tf})$ indicates a time frequency index.

Then, the spatial transfer characteristic matrix generating unit 68 performs the spatial frequency transform on the time frequency spectrum $G_{measure}(l,m,n_{tf})$. At this time, the IDFT used in the spatial frequency analyzing unit 62 is used as the spatial frequency transform.

For example, an IDFT for obtaining the spatial frequency spectrum $S_{SP}(p)$ from the time frequency spectrum S(q) which is defined in the following formula (4) in which p and q indicate the spatial frequency index and time frequency index is assumed to be considered. In Formula (4), M is the number of samples of the IDFT.

[Math. 4]

$$S_{SP}(p) = \frac{1}{M}\sum_{q=0}^{M-1} S(q)e^{j\frac{2\pi pq}{M}} \tag{4}$$

Here, if a variable W is defined as in the following Formula (5), the IDFT indicated by Formula (4) is indicated as in the following Formula (6).

[Math. 5]

$$W \equiv e^{-j\frac{2\pi}{M}} \tag{5}$$

[Math. 6]

$$S_{SP}(p) = \frac{1}{M}\sum_{q=0}^{M-1} S(q)W^{-pq} \tag{6}$$

If a matrix is used, Formula (6) obtained as described above is indicated as in the following Formula (7).

[Math. 7]

$$\begin{bmatrix} S_{SP}(0) \\ S_{SP}(1) \\ S_{SP}(2) \\ \vdots \\ S_{SP}(M-1) \end{bmatrix} = \frac{1}{M}\begin{bmatrix} W^0 & W^0 & W^0 & \ldots & W^0 \\ W^0 & W^{-1} & W^{-2} & \ldots & W^{-(M-1)} \\ W^0 & W^{-2} & W^{-4} & \ldots & W^{-2(M-1)} \\ \vdots & \vdots & \vdots & \ddots & \vdots \\ W^0 & W^{-(M-1)} & W^{-2(M-1)} & \ldots & W^{-(M-1)^2} \end{bmatrix}\begin{bmatrix} S(0) \\ S(1) \\ S(2) \\ \vdots \\ S(M-1) \end{bmatrix} \tag{7}$$

Further, if the time frequency spectrum S(q) and the spatial frequency spectrum $S_{SP}(p)$ are indicated by vectors S and $S_{SP}$, and the inverse discrete Fourier transform matrix is indicated by F, Formula (7) is indicated as in the following Formula (8).

[Math. 8]

$$S_{SP} = \frac{1}{M} FS \tag{8}$$

The spatial transfer characteristic matrix generating unit 68 obtains the spatial transfer characteristic matrix indicating the spatial transfer characteristic obtained by the actual measurement from each of the speakers constituting the linear speaker array 22 to each of the microphones constituting the linear microphone array 101 by performing the spatial frequency transform using the inverse discrete Fourier transform matrix F.

More specifically, in the spatial transfer characteristic matrix generating unit 68, a matrix in which the time frequency spectrums $G_{measure}(l,m,n_{tf})$ of the speaker indices 1 are arranged in a row direction, and the time frequency spectrums $G_{measure}(l,m,n_{tf})$ of the microphone indices m are arranged in a column direction is defined as a matrix $G_{measure}(n_{tf})$.

Then, the spatial transfer characteristic matrix generating unit 68 performs a calculation indicated by the following Formula (9) on the basis of the matrix $G_{measure}(n_{tf})$ and the inverse discrete Fourier transform matrix F, and calculates a spatial transfer characteristic matrix $G_{measure}'(n_{tf})$ through the spatial frequency transform.

[Math. 9]

$$G_{measure}'(n_{tf}) = F^H G_{measure}(n_{tf}) F \tag{9}$$

In Formula (9), $F^H$ indicates a Hermitian transposed matrix of the inverse discrete Fourier transform matrix F, and in Formula (9), the spatial sampling rate is assumed to be equal to that in the case of the spatial frequency transform performed by the spatial frequency analyzing unit 62.

The spatial transfer characteristic matrix $G_{measure}'(n_{tf})$ obtained as described above is a matrix having the spatial frequency spectrum indicating the actually measured spatial transfer characteristic from each of the speakers constituting the linear speaker array 22 to each of the microphones constituting the linear microphone array 101 as an element.

The inverse discrete Fourier transform matrix F and the Hermitian transposed matrix $F^H$ thereof are assumed to be matrices configured with eigenvectors of the matrix $G_{measure}(n_{tf})$. In this case, the spatial transfer characteristic matrix $G_{measure}'(n_{tf})$ is generally diagonalized, and eigenvalues appear on the diagonal components of the matrix.

In this regard, the spatial transfer characteristic matrix generating unit 68 extracts some or all of the elements of the spatial transfer characteristic matrix $G_{measure}'(n_{tf})$, sets them as the spatial transfer characteristic matrix $G_{diag}'(n_{tf})$, the spatial transfer characteristic matrix $G_{tridiag}'(n_{tf})$ the spatial transfer characteristic matrix $G_{block}(n_{tf})$, and the spatial transfer characteristic matrix $G_{all}'(n_{tf})$, and obtains a spatial transfer characteristic matrix which is different in the operation amount of the spatial correction process.

In other words, the spatial transfer characteristic matrix generating unit 68 sets a matrix obtained by extracting only the diagonal component of the spatial transfer characteristic matrix $G_{measure}'(n_{tf})$ as a spatial transfer characteristic matrix $G_{diag}'(n_{tf})$.

Further, the spatial transfer characteristic matrix generating unit 68 sets a matrix in which only triple diagonal components of spatial transfer characteristic matrix $G_{measure}'(n_{tf})$ are extracted as the spatial transfer characteristic matrix $G_{tridiag}'(n_{tf})$, and sets a matrix in which only specific blocks of the spatial transfer characteristic matrix $G_{measure}'(n_{tf})$ are extracted as the spatial transfer characteristic matrix $G_{block}'(n_{tf})$.

Here, the specific block refers to an element group configured with a plurality of elements which are arranged adjacent to each other in the spatial transfer characteristic matrix $G_{measure}'(n_{tf})$. The number of blocks extracted from the spatial transfer characteristic matrix $G_{measure}'(n_{tf})$ may be one or two or more.

For example, when the spatial Nyquist frequency is indicated by $k_{Nyq}$, a time frequency of $k_{Nyq}$ of $c/2\pi$ or less is called an evanescent region, and energy of the spatial transfer characteristic is very small. In this regard, a matrix obtained by excluding the evanescent region part from the spatial transfer characteristic matrix $G_{measure}'(n_{tf})$ may be set as the spatial transfer characteristic matrix $G_{block}'(n_{tf})$.

Further, the spatial transfer characteristic matrix generating unit 68 sets the spatial transfer characteristic matrix $G_{measure}'(n_{tf})$ as the spatial transfer characteristic matrix $G_{all}'(n_{tf})$.

The characteristics of the spatial transfer characteristic matrix $G_{diag}'(n_{tf})$ through the spatial transfer characteristic matrix $G_{all}'(n_{tf})$ will be described later. Here, the example of obtaining four types of spatial transfer characteristic matrices has been described as an example, but some elements of the spatial transfer characteristic matrix $G_{measure}'(n_{tf})$ may be extracted by a method other than the method described above. Further, five or more or three or less spatial transfer characteristic matrices may be generated from the spatial transfer characteristic matrix $G_{measure}'(n_{tf})$.

The spatial transfer characteristic matrix generating unit 68 generates the spatial transfer characteristic matrix $G_{ideal}'(n_{tf})$, the spatial transfer characteristic matrix $G_{diag}'(n_{tf})$, the spatial transfer characteristic matrix $G_{tridiag}'(n_{tf})$ the spatial transfer characteristic matrix $G_{block}'(n_{tf})$, and the spatial transfer characteristic matrix $G_{all}'(n_{tf})$ in advance and holds them.

Then, the spatial transfer characteristic matrix generating unit 68 selects one spatial transfer characteristic matrix specified by the selection result of the spatial correction scheme supplied from the spatial correction scheme selecting unit 67 from among the spatial transfer characteristic matrices, and supplies the selected spatial transfer characteristic matrix to the drive signal generating unit 69.

(Spatial Correction Scheme Selecting Unit)

The spatial correction scheme selecting unit 67 selects one of the spatial transfer characteristic matrix $G_{ideal}'(n_{tf})$, the spatial transfer characteristic matrix $G_{diag}'(n_{tf})$, the spatial transfer characteristic matrix $G_{tridiag}'(n_{tf})$, the spatial transfer characteristic matrix $G_{block}'(n_{tf})$, and the spatial transfer characteristic matrix $G_{all}'(n_{tf})$ which are held in the spatial transfer characteristic matrix generating unit 68 as the spatial transfer characteristic matrix to be used for the spatial correction process on the basis of the spatial correction information fig supplied from the decoding unit 66. The selecting of the spatial transfer characteristic matrix to be used for the spatial correction process can be regarded as selecting of the spatial correction scheme which is the spatial correction process scheme.

In the following description, the spatial transfer characteristic matrix used for the spatial correction process selected by the spatial correction scheme selecting unit 67 is referred to as a "spatial transfer characteristic matrix $G'(n_{tf})$."

The spatial correction scheme selecting unit 67 supplies information indicating the spatial transfer characteristic matrix $G'(n_{tf})$ selected as described above to the spatial transfer characteristic matrix generating unit 68 as the selection result of the spatial correction scheme. Then, the spatial transfer characteristic matrix generating unit 68 supplies the spatial transfer characteristic matrix $G'(n_{tf})$ indicated by the information supplied from the spatial correction scheme selecting unit 67 to the drive signal generating unit 69.

Here, an example in which the spatial transfer characteristic matrix $G'(n_{tf})$ is selected on the basis of the spatial correction information flg received from the transmitter 11 is described, but, for example, the spatial transfer characteristic matrix $G'(n_{tf})$ may be selected using information acquired from the outside such as the spatial correction information flg input by the user who listens to the content or the like. In this case, for example, the spatial correction information flg input by the user or the like is supplied from an input unit (not illustrated) to the spatial correction scheme selecting unit 67.

Further, in a case in which the spatial correction information flg is not received from the transmitter 11 or in a case in which there is no external input of the spatial correction information flg, the spatial correction scheme selecting unit 67 selects an arbitrary spatial transfer characteristic matrix $G'(n_{tf})$.

Here, the spatial transfer characteristic matrices held in the spatial transfer characteristic matrix generating unit 68 are matrices in which each element is correctable.

In FIG. 5, $G_{ideal}'(n_{tf})$, $G_{diag}'(n_{tf})$, $G_{tridiag}'(n_{tf})$, $G_{block}'(n_{tf})$ and $G_{all}'(n_{tf})$ indicate the spatial transfer characteristic matrix $G_{ideal}'(n_{tf})$, the spatial transfer characteristic matrix $G_{diag}'(n_{tf})$, the spatial transfer characteristic matrix $G_{tridiag}'(n_{tf})$, the spatial transfer characteristic matrix $G_{block}'(n_{tf})$, and the spatial transfer characteristic matrix $G_{all}'(n_{tf})$.

Further, in a left column of FIG. 5, "speaker characteristic," "reflection from wall parallel to linear speaker array direction," "reverberation," and "reflection from wall not parallel to linear speaker array direction" are indicated as correction elements in the spatial correction process.

Here, "speaker characteristic" indicates a frequency characteristic of the linear speaker array 22 or a frequency characteristic of each of the speakers constituting the linear speaker array 22, and if this correction element is corrected, the frequency characteristic becomes flat.

"Reflection from wall parallel to linear speaker array direction" indicates a reflected sound from a wall having a plane parallel to a direction in which the speakers constituting the linear speaker array 22 are arranged in the reproduction space, and if this correction element is corrected, the listener hardly hears the reflected sound.

"Reverberation" indicates reverberation in the reproduction space, and if this correction element is corrected, the listener hardly hears the reverberant sound generated in the reproduction space.

Further, "reflection from wall not parallel to linear speaker array direction" indicates a reflected sound from a wall having a plane which is not parallel to the direction in which the speakers constituting the linear speaker array 22 are arranged in the reproduction space, and if this correction element is corrected, the listener hardly hears the reflected sound.

Further, symbols "○," "Δ," or "x" written in each column indicates a degree to which each correction element is corrected by the spatial correction process using each spatial transfer characteristic matrix. Specifically, "○" indicates that the correction element is sufficiently corrected, "Δ" indicates that the correction element is corrected to some extent, ad "x" indicates that the correction element is hardly corrected.

Here, in each spatial transfer characteristic matrix, an operation amount in the spatial correction process increases rightwards in FIG. 5. In other words, the operation amount in the spatial correction process is smallest when the spatial transfer characteristic matrix $G_{ideal}'(n_{tf})$ is used and largest when the spatial transfer characteristic matrix $G_{all}'(n_{tf})$ is used.

Conversely, in each spatial transfer characteristic matrix, the number of elements to be corrected and the spatial reproducibility increase rightwards in FIG. 5.

For example, since the spatial transfer characteristic matrix $G_{ideal}'(n_{tf})$ indicates an ideal spatial transfer characteristic, although the spatial correction process is performed using the spatial transfer characteristic matrix $G_{ideal}'(n_{tf})$, any correction element is not substantially corrected. In other words, in a case in which the spatial transfer characteristic matrix $G_{ideal}'(n_{tf})$ is used, the operation amount can be suppressed to be low, the high spatial reproducibility is unable to be obtained.

Further, the spatial transfer characteristic matrix $G_{diag}'(n_{tf})$, the spatial transfer characteristic matrix $G_{tridiag}'(n_{tf})$, the spatial transfer characteristic matrix $G_{block}'(n_{tf})$, and the spatial transfer characteristic matrix $G_{all}'(n_{tf})$ are matrices obtained by extracting some or all elements of the spatial transfer characteristic matrix $G_{measure}'(n_{tf})$.

As the number of speakers constituting the linear speaker array 22 increases, the inverse discrete Fourier transform matrix F and the Hermitian transposed matrix $F^H$ thereof get closer to the matrix configured with eigenvectors, and thus the energy of the spatial transfer characteristic matrix $G_{measure}'(n_{tf})$ is concentrated on the diagonal components.

Particularly, if the inverse discrete Fourier transform matrix F and the Hermitian transposed matrix $F^H$ are matrices configured with the eigenvectors of the matrix $G_{measure}(n_{tf})$, components related to "speaker characteristic," "reflection from wall parallel to linear speaker array direction," and "reverberation" are included as the diagonal component of the spatial transfer characteristic matrix $G_{measure}'(n_{tf})$.

In this case, if the spatial correction process is performed using the spatial transfer characteristic matrix $G_{diag}'(n_{tf})$ obtained by extracting only the diagonal components of the spatial transfer characteristic matrix $G_{measure}'(n_{tf})$, the correction element can be sufficiently correct with a small operation amount, and thus the high spatial reproducibility can be expected to be implemented.

However, it is difficult to sufficiently correct components related to the reflection from the wall which is not parallel to the direction of the linear speaker array 22 or the linear microphone array 101 using the spatial transfer characteristic matrix $G_{diag}'(n_{tf})$. This is because the reflection from the wall having a plane perpendicular to the direction of the linear speaker array 22, for example, is a mirror image relation with the sound, and thus reflection component appears in an inverse diagonal component of the spatial transfer characteristic matrix $G_{measure}'(n_{tf})$.

Further, depending on the reproduction environment such as the reproduction space, the component related to reverberation in the reproduction space may appear in the inverse diagonal component of the spatial transfer characteristic matrix $G_{measure}'(n_{tf})$. Therefore, depending on circumstances, the reverberant sound may not be sufficiently corrected using the spatial transfer characteristic matrix $G_{diag}'(n_{tf})$.

For the reflection and the reverberation from the wall not parallel to the direction of the linear speaker arrays 22, the same applies to not only the spatial transfer characteristic matrix $G_{diag}'(n_{tf})$ but also the spatial transfer characteristic matrix $G_{tridiag}'(n_{tf})$ and the spatial transfer characteristic matrix $G_{block}'(n_{tf})$.

Further, as the number of speakers constituting the linear speaker array 22 decreases, more energy of the spatial transfer characteristic matrix $G_{measure}'(n_{tf})$ leaks to the non-diagonal component.

However, in this case, a certain number of components leaked to the non-diagonal component are included in the spatial transfer characteristic matrix $G_{tridiag}'(n_{tf})$ obtained by extracting only the triple diagonal component of the spatial transfer characteristic matrix $G_{measure}'(n_{tf})$.

For this reason, if the spatial correction process is performed using the spatial transfer characteristic matrix $G_{tridiag}'(n_{tf})$, the operation amount increases to be larger than in a case in which the spatial transfer characteristic matrix $G_{diag}'(n_{tf})$ is used, but the spatial reproducibility can be improved accordingly.

For the same reason, more components leaked to the non-diagonal component are included in the spatial transfer characteristic matrix $G_{block}'(n_{tf})$ obtained by extracting only the specific block of the spatial transfer characteristic matrix $G_{measure}'(n_{tf})$ than in the spatial transfer characteristic matrix $G_{tridiag}'(n_{tf})$.

Therefore, if the spatial correction process is performed using the spatial transfer characteristic matrix $G_{block}'(n_{tf})$ the operation amount increases to be larger than in a case in which the spatial transfer characteristic matrix $G_{tridiag}'(n_{tf})$ is used, but the spatial reproducibility can be improved.

However, as described above, in the spatial correction process using the spatial transfer characteristic matrix $G_{diag}'(n_{tf})$ the spatial transfer characteristic matrix $G_{tridiag}'(n_{tf})$, or the spatial transfer characteristic matrix $G_{block}'(n_{tf})$, correction related to "reflection from wall not parallel to linear speaker array direction is unable to be sufficiently performed.

In this regard, in a case in which it is desired to improve the spatial reproducibility even though the operation amount increases, all the elements are corrected by performing the spatial correction process using the spatial transfer characteristic matrix $G_{all}'(n_{tf})$, and thus the highest spatial reproducibility can be realized.

As described above, since a plurality of spatial transfer characteristic matrices are prepared in accordance with the operation amount, a more appropriate spatial correction process can be performed in accordance with the content or the like Particularly, in this case, the operation amount of the spatial correction process falls between O(n) and $O(n^2)$, and it is possible to reduce the operation amount.

Further, when the spatial transfer characteristic matrix $G'(n_{tf})$ is selected, the spatial correction scheme selecting unit 67 corrects the spatial correction information flg on the basis of a weight $W_{sp}$ related to the number of speakers constituting the linear speaker array 22 and a weight $W_{power}$ related to an operation capability of the receiver 12, that is, a total amount of operation resources. In other words, the spatial correction scheme selecting unit 67 selects the spatial correction scheme on the basis of the spatial correction information flg, the number of speakers of the linear speaker array 22, and the operation capability of the receiver 12.

Specifically, final spatial correction information flg is obtained, for example, by multiplying the spatial correction information flg supplied from the decoding unit 66 by the weight $W_{SP}$ and the weight $W_{power}$ which are held in advance or input by the user or the like.

Here, for example, the weight $W_{SP}$ is set to be smaller than 1 in a case in which the number of speakers constituting the linear speaker array 22 is relatively large and is set to a value larger than 1 in a case in which the number of speakers is small. Further, for example, the weight $W_{power}$ is set to be larger than 1 if the operation capability of the receiver 12 is relatively high and be smaller than 1 if the operation capability is low.

The spatial correction scheme selecting unit 67 compares the spatial correction information flg appropriately corrected as described above with some predetermined threshold values, and selects the spatial correction scheme.

For example, the spatial correction scheme selecting unit 67 sets a threshold value $\theta_{ideal}$, a threshold value $\theta_{diag}$, a threshold value $\theta_{tridiag}$, and a threshold value $\theta_{block}$ for the spatial transfer characteristic matrix $G_{ideal}'(n_{tf})$, the spatial transfer characteristic matrix $G_{diag}'(n_{tf})$, the spatial transfer characteristic matrix $G_{tridiag}'(n_{tf})$, and the spatial transfer characteristic matrix $G_{block}'(n_{tf})$.

Here, threshold value $\theta_{ideal}$<threshold value $\theta_{diag}$<threshold value $\theta_{tridiag}$<threshold value $\theta_{block}$ is held.

The spatial correction scheme selecting unit 67 compares the spatial correction information flg with the threshold value $\theta_{ideal}$ through the threshold value $\theta_{block}$ and selects the spatial transfer characteristic matrix corresponding to the threshold value having the smallest value among the threshold values larger than the spatial correction information flg as the spatial transfer characteristic matrix $G'(n_{tf})$. Further, the spatial correction scheme selecting unit 67 selects the spatial transfer characteristic matrix $G_{all}'(n_{tf})$ as the spatial transfer characteristic matrix $G'(n_{tf})$ in a case in which the spatial correction information flg is larger than the threshold value $\theta_{block}$.

Further, the method of selecting the spatial transfer characteristic matrix $G'(n_{tf})$ may be any other method, for example, the spatial transfer characteristic matrix corresponding to the threshold value closest to the spatial correction information flg may be selected.

(Drive Signal Generating Unit)

The drive signal generating unit 69 obtains a speaker drive signal $D_{SP}(n_{tf},n_{sf})$ of the spatial frequency domain by calculating the following Formula (10) using the spatial transfer characteristic matrix $G'(n_{tf})$ supplied from the spatial transfer characteristic matrix generating unit 68 and the spatial frequency spectrum $S_{SP}(n_{tf},n_{sf})$ supplied from the decoding unit 66.

[Math. 10]

$$D_{SP}(n_{tf}, n_{sf}) = \tag{10}$$

$$\begin{cases} G'^{+}(n_{tf})S_{SP}(n_{tf}, n_{sf})\exp\left(-j\sqrt{\left(\frac{\omega}{c}\right)^2 - k_x^2}\cdot y\right), \text{ for } 0 \le |k_x| < \left|\frac{\omega}{c}\right| \\ G'^{+}(n_{tf})S_{SP}(n_{tf}, n_{sf})\exp\left(-j\sqrt{k_x^2 - \left(\frac{\omega}{c}\right)^2}\cdot y\right), \text{ for } 0 < \left|\frac{\omega}{c}\right| < |k_x| \end{cases}$$

Through the calculation of Formula (10), the spatial correction process using the spatial transfer characteristic matrix $G'(n_{tf})$ is performed, signal deterioration occurring at the time of sound reproduction due to the spatial transfer characteristic of the reproduction space is corrected in advance, and the speaker drive signal of the spatial frequency domain in which such correction is performed is calculated.

The spatial correction process is a process of correcting the spatial transfer characteristic using the spatial transfer characteristic matrix $G'(n_{tf})$. In other words, the spatial transfer characteristic used in the calculation is corrected to be closer to an actual one using the spatial transfer characteristic matrix $G'(n_{tf})$ indicating the spatial transfer characteristic obtained from the actual measurement result as the spatial transfer characteristic of the reproduction space used in the calculation of Formula (10) in a case in which the speaker drive signal $D_{SP}(n_{tf},n_{sf})$ is calculated. Accordingly, the speaker drive signal in which the signal deterioration occurring at the time of reproduction due to the spatial transfer characteristic of the actual reproduction space is corrected in advance, that is, the spatial transfer characteristic is corrected is calculated.

In Formula (10), $G'^{+}(n_{tf})$ is a pseudo inverse matrix of the spatial transfer characteristic matrix $G'(n_{tf})$. Further, "j" indicates a pure imaginary number, $k_x$ indicates the spatial frequency in the x-axis direction, ω indicates a time angular frequency, and "c" indicates a sound speed.

In Formula (10), "y" indicates a distance between the linear microphone array 101 and the linear speaker array 22 in the y-axis direction.

Further, here, the spatial sampling rate of the spatial frequency spectrum $S_{SP}(n_{tf},n_{sf})$ and the spatial sampling rate of the spatial transfer characteristic matrix $G'(n_{tf})$ are assumed to be equal. However, in a case in which the spatial sampling rates are different, it is necessary to match the spatial sampling rate of one of the spatial frequency spectrum $S_{SP}(n_{tf},n_{sf})$ and the spatial transfer characteristic matrix $G'(n_{tf})$ with the spatial sampling rate of the other or to perform the process so that the spatial sampling rates are equal.

Further, here, the number of samples of the spatial frequency spectrum $S_{SP}(n_{tf},n_{sf})$ and the number of samples of the spatial transfer characteristic matrix $G'(n_{tf})$ are assumed to be equal. However, if the numbers of samples are different, it is necessary to match the number of samples of one of the spatial frequency spectrum $S_{SP}(n_{tf},n_{sf})$ and the spatial transfer characteristic matrix $G'(n_{tf})$ with the number of samples of the other or to perform the process such as zero padding or high frequency removal appropriately so that the numbers of samples are equal.

Furthermore, the method of calculating the speaker drive signal $D_{SP}(n_{tf},n_{sf})$ using a spectral division method (SDM) has been described as an example here, but the speaker drive signal may be calculated by any other method. The SDM is described in detail, particularly, in "Jens Adrens, Sascha Spors, "Applying the Ambisonics Approach on Planar and Linear Arrays of Loudspeakers," in 2-nd International Symposium on Ambisonics and Spherical Acoustics."

The drive signal generating unit 69 supplies the obtained speaker drive signal $D_{SP}(n_{tf},n_{sf})$ to the spatial frequency synthesizing unit 70.

(Spatial Frequency Synthesizing Unit)

The spatial frequency synthesizing unit 70 obtains a time frequency spectrum $D(l,n_{tf})$ by performing the spatial frequency synthesis using the DFT on the spatial frequency spectrum which is the speaker drive signal $D_{SP}(n_{tf},n_{sf})$ supplied from the drive signal generating unit 69. In other words, a calculation of the following Formula (11) is performed, and the spatial frequency synthesis is performed on the speaker drive signal $D_{SP}(n_{tf},n_{sf})$.

[Math. 11]

$$D(l, n_{tf}) = \sum_{n_{sf}=0}^{M_{ds}-1} D_{SP}(n_{tf}, n_{sf}) e^{-j\frac{2\pi l n_{sf}}{M_{ds}}} \tag{11}$$

In Formula (11), "l" denotes a speaker index identifying the speaker constituting the linear speaker array 22, and $M_{ds}$ denotes the number of samples of the DFT.

The spatial frequency synthesizing unit 70 supplies the time frequency spectrum $D(l,n_{tf})$ obtained through spatial frequency synthesis to the time frequency synthesizing unit 71.

(Time Frequency Synthesizing Unit)

The time frequency synthesizing unit 71 performs the time frequency synthesis using IDFT on the time frequency spectrum $D(l,n_{tf})$ supplied from the spatial frequency synthesizing unit 70 by calculating the following Formula (12), and calculates the speaker drive signal $d(l,n_d)$ which is the time signal.

[Math. 12]

$$d(l, n_d) = \frac{1}{M_{dt}} \sum_{n_{tf}=0}^{M_{dt}-1} D(l, n_{tf}) e^{j\frac{2\pi n_d n_{tf}}{M_{dt}}} \tag{12}$$

In Formula (12), $n_d$ indicates a time index, and $M_{dt}$ indicates the number of samples of IDFT.

The time frequency synthesizing unit 71 supplies the speaker drive signal $d(l,n_d)$ obtained as described above to each of the speakers constituting the linear speaker array 22 so that the sound is reproduced.

<Decryption of Spatial Transfer Characteristic Matrix Generation Process>

Next, the flow of a process performed by the spatial correction controller 51 described above will be described.

For example, if the spatial transfer characteristic is measured using the linear speaker array 22 and the linear microphone array 101 on the reproduction space, and the time signal $g_{measure}(l,m,n_c)$ obtained as a result is supplied to the spatial transfer characteristic matrix generating unit 68, the spatial correction controller 51 performs the spatial transfer characteristic matrix generation process and generates the spatial transfer characteristic matrix to be used in each spatial correction scheme.

Figure 6:
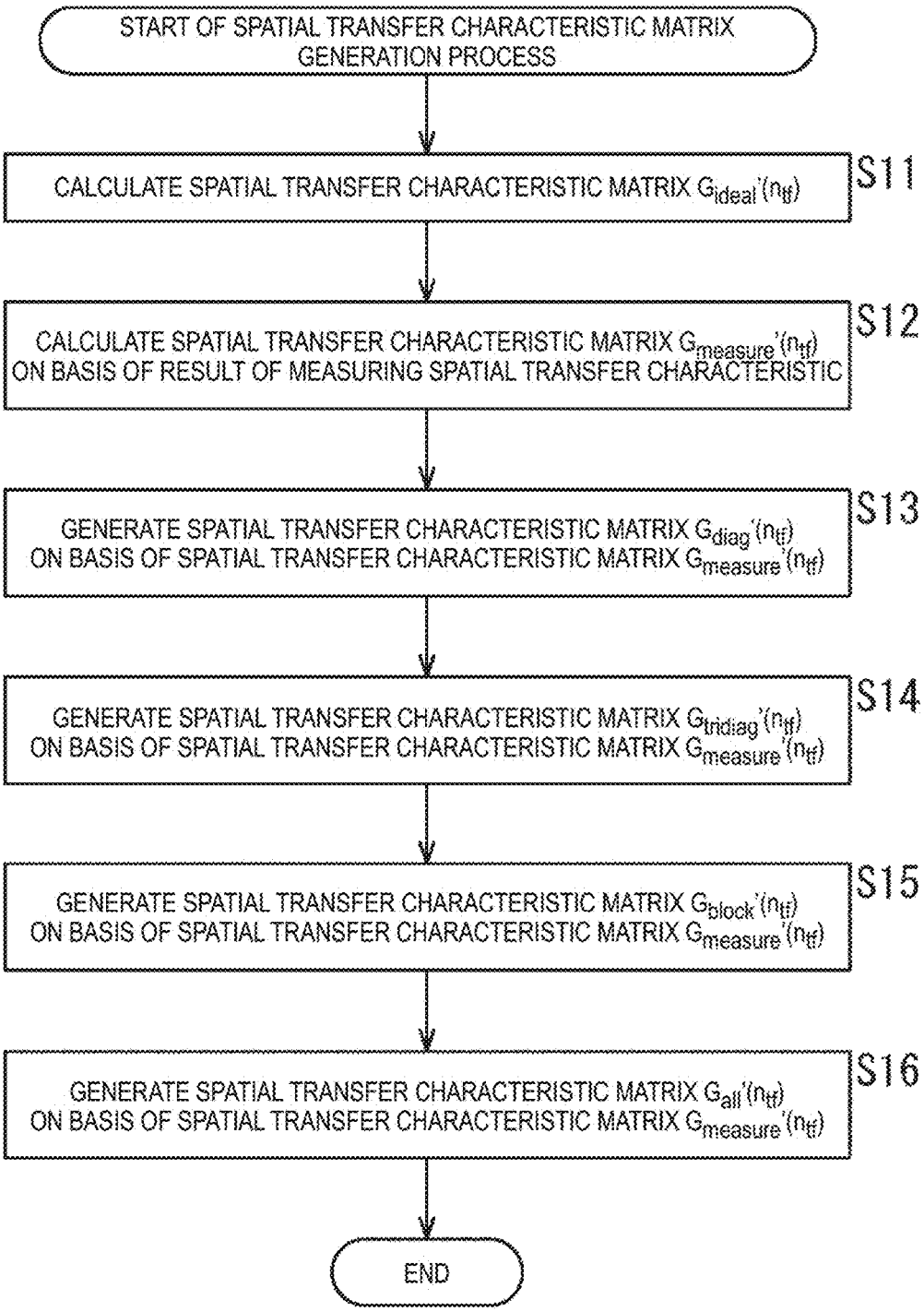
FIG. 6 is a flowchart for describing a spatial transfer characteristic matrix generation process.

The spatial transfer characteristic matrix generation process performed by the spatial correction controller 51 will now be described with reference to a flowchart of FIG. 6.

In step S11, the spatial transfer characteristic matrix generating unit 68 calculates the spatial transfer characteristic matrix $G_{ideal}'(n_{tf})$ indicating the ideal spatial transfer characteristic. For example, in step S11, the spatial transfer characteristic matrix $G_{ideal}'(n_{tf})$ is calculated by performing the calculation of Formula (3).

In step S12, the spatial transfer characteristic matrix generating unit 68 calculates the spatial transfer characteristic matrix $G_{measure}'(n_{tf})$ on the basis of the result of measuring the spatial transfer characteristic.

For example, the spatial transfer characteristic matrix generating unit 68 performs the time frequency transform on the time signal $g_{measure}(l,m,n_c)$ which is the result of measuring the spatial transfer characteristic, and calculates the time frequency spectrum $G_{measure}(l,m,n_{tf})$.

Then, the spatial transfer characteristic matrix generating unit 68 calculates the spatial transfer characteristic matrix $G_{measure}'(n_{tf})$ by calculating Formula (9) on the basis of the obtained time frequency spectrum $G_{measure}(l,m,n_{tf})$.

In step S13, the spatial transfer characteristic matrix generating unit 68 generates the spatial transfer characteristic matrix $G_{diag}'(n_{tf})$ on the basis of the spatial transfer characteristic matrix $G_{measure}'(n_{tf})$.

For example, the spatial transfer characteristic matrix generating unit 68 extracts only the diagonal components of the spatial transfer characteristic matrix $G_{measure}'(n_{tf})$ and sets them as the spatial transfer characteristic matrix $G_{diag}'(n_{tf})$.

In step S14, the spatial transfer characteristic matrix generating unit 68 generates the spatial transfer characteristic matrix $G_{tridiag}'(n_{tf})$ on the basis of the spatial transfer characteristic matrix $G_{measure}'(n_{tf})$.

For example, the spatial transfer characteristic matrix generating unit 68 extracts only the triple diagonal components of the spatial transfer characteristic matrix $G_{measure}'(n_{tf})$ and sets them as the spatial transfer characteristic matrix $G_{tridiag}'(n_{tf})$.

In step S15, the spatial transfer characteristic matrix generating unit 68 generates the spatial transfer characteristic matrix $G_{block}'(n_{tf})$ on the basis of the spatial transfer characteristic matrix $G_{measure}'(n_{tf})$.

For example, the spatial transfer characteristic matrix generating unit 68 extracts only the specific blocks of the spatial transfer characteristic matrix $G_{measure}'(n_{tf})$ and sets them as the spatial transfer characteristic matrix $G_{block}'(n_{tf})$.

In step S16, the spatial transfer characteristic matrix generating unit 68 generates the spatial transfer characteristic matrix $G_{all}'(n_{tf})$ on the basis of the spatial transfer characteristic matrix $G_{measure}'(n_{tf})$.

For example, the spatial transfer characteristic matrix generating unit 68 sets the spatial transfer characteristic matrix $G_{measure}'(n_{tf})$ as the spatial transfer characteristic matrix $G_{all}'(n_{tf})$.

When the spatial transfer characteristic matrix $G_{ideal}'(n_{tf})$, the spatial transfer characteristic matrix $G_{diag}'(n_{tf})$, the spatial transfer characteristic matrix $G_{tridiag}'(n_{tf})$, the spatial transfer characteristic matrix $G_{block}'(n_{tf})$ and the spatial transfer characteristic matrix $G_{all}'(n_{tf})$ are generated, the spatial transfer characteristic matrix generating unit 68 holds the spatial transfer characteristic matrices, and then ends the spatial transfer characteristic matrix generation process.

As described above, the spatial correction controller 51 generates and holds a plurality of spatial transfer characteristic matrices having different operation amounts at the time of the spatial correction process on the basis of the actually measured spatial transfer characteristics.

Accordingly, a more appropriate spatial correction process can be performed in accordance with the spatial correction information flg, that is, in accordance with the content. In other words, the acoustic field can be more appropriately reproduced in accordance with the content.

<Description of Acoustic Field Reproduction Process>

If the spatial transfer characteristic matrix of each spatial correction scheme is generated by performing the spatial transfer characteristic matrix generation process, the spatial correction controller 51 can perform an acoustic field reproduction process of reproducing the acoustic field of the sound collection space in the reproduction space.

Figure 7:
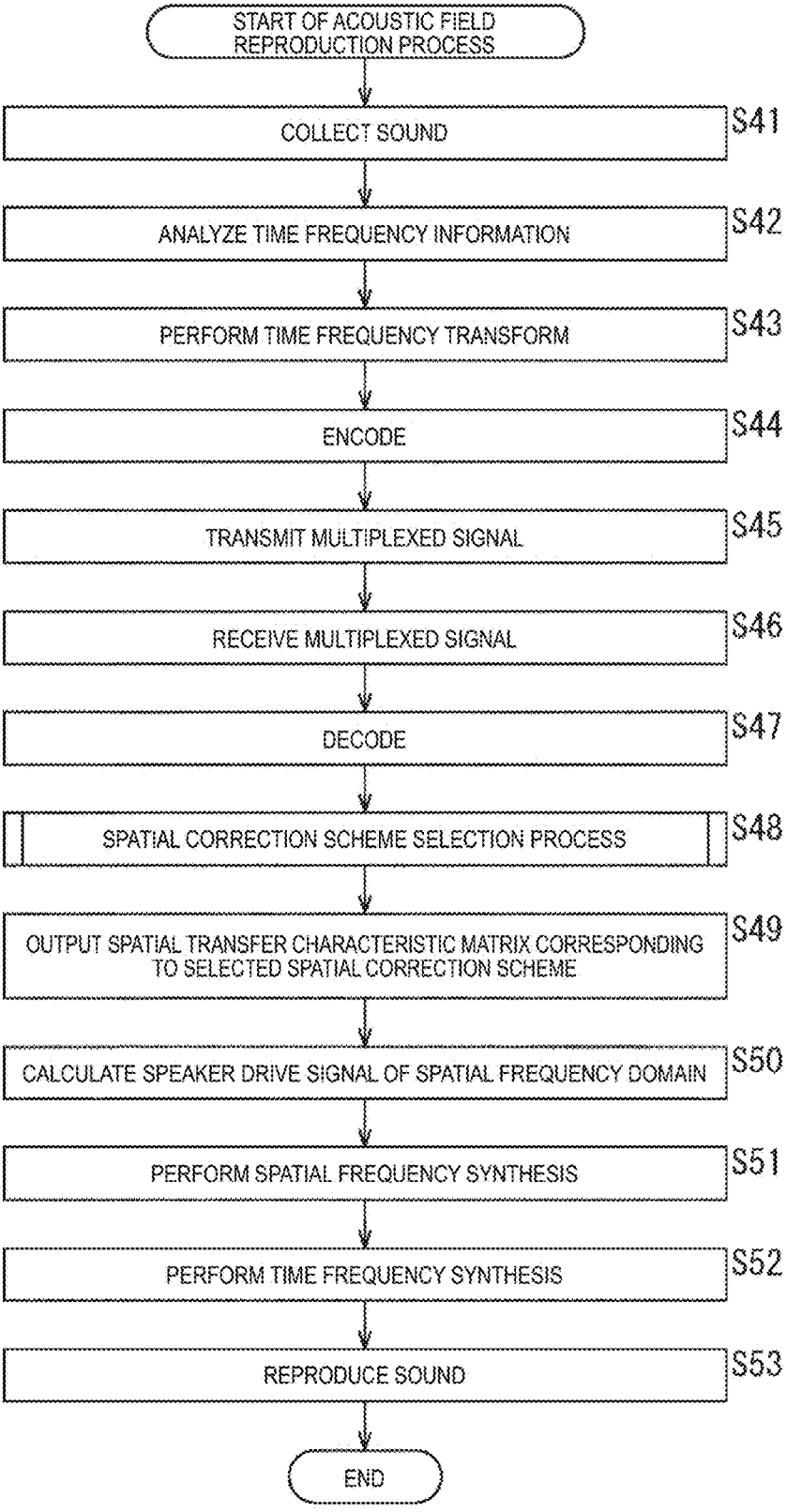
FIG. 7 is a flowchart for describing an acoustic field reproduction process.

Next, the acoustic field reproduction process performed by the spatial correction controller 51 will be described with reference to the flowchart of FIG. 7.

In step S41, the linear microphone array 21 collects the sound of the content in the sound collection space and supplies the multichannel sound collection signal $s(i,n_t)$ obtained as a result to the time frequency analyzing unit 61.

In step S42, the time frequency analyzing unit 61 analyzes the time frequency information of the sound collection signal $s(i,n_t)$ supplied from the linear microphone array 21.

Specifically, the time frequency analyzing unit 61 performs the time frequency transform on the sound collection signal $s(i,n_t)$ and supplies the time frequency spectrum $S(i,n_{tf})$ obtained as a result to the spatial frequency analyzing unit 62. For example, in step S42, the calculation of Formula (1) is performed.

In step S43, the spatial frequency analyzing unit 62 performs the spatial frequency transform on the time frequency spectrum $S(i,n_{tf})$ supplied from the time frequency analyzing unit 61, and supplies the spatial frequency spectrum $S_{SP}(n_{tf},n_{sf})$ obtained as a result to the encoding unit 63. For example, in step S43, the calculation of Formula (2) is performed.

In step S44, the encoding unit 63 encodes the spatial frequency spectrum $S_{SP}(n_{tf},n_{sf})$ supplied from the spatial frequency analyzing unit 62 and the spatial correction information flg input by the content creator or the like, and supplies the multiplexed signal obtained as a result to the communication unit 64.

Here, the spatial correction information flg to be stored in the multiplexed signal can be switched in arbitrary time units such as in units of content or in units of content frames. In a case in which the spatial correction information flg is switched in predetermined time units, the encoding unit 63 acquires the spatial correction information flg at an appropriate timing if the switching is performed.

In step S45, the communication unit 64 transmits the multiplexed signal supplied from the encoding unit 63.

In step S46, the communication unit 65 receives the multiplexed signal transmitted through the communication unit 64 and supplies it to the decoding unit 66.

In step S47, the decoding unit 66 decodes the multiplexed signal supplied from the communication unit 65, supplies the spatial correction information flg obtained as a result to the spatial correction scheme selecting unit 67, and supplies the spatial frequency spectrum $S_{SP}(n_{tf},n_{sf})$ obtained by the decoding to the drive signal generating unit 69.

In step S48, the spatial correction scheme selecting unit 67 performs the spatial correction scheme selection process, selects the spatial correction scheme on the basis of the spatial correction information flg supplied from the decoding unit 66, and outputs the selection result to the spatial transfer characteristic matrix generating unit 68. The spatial correction scheme selection process will be described in detail later.

In step S49, the spatial transfer characteristic matrix generating unit 68 outputs the spatial transfer characteristic matrix corresponding to the selected spatial correction scheme on the basis of the information indicating the selection result of the spatial correction scheme supplied from the spatial correction scheme selecting unit 67.

For example, the spatial transfer characteristic matrix generating unit 68 sets the spatial transfer characteristic matrix indicated by the information indicating the selection result of the spatial correction scheme supplied from the spatial correction scheme selecting unit 67 among the spatial transfer characteristic matrix $G_{ideal}'(n_{tf})$, the spatial transfer characteristic matrix $G_{diag}'(n_{tf})$, the spatial transfer characteristic matrix $G_{tridiag}'(n_{tf})$, the spatial transfer characteristic matrix $G_{block}'(n_{tf})$ and the spatial transfer characteristic matrix $G_{all}'(n_{tf})$ which are held as the spatial transfer characteristic matrix $G'(n_{tf})$, and supplies the spatial transfer characteristic matrix $G'(n_{tf})$ to the drive signal generating unit 69.

Here, the example in which the spatial transfer characteristic matrix is generated through the spatial transfer characteristic matrix generation process in advance has been described. However, the spatial transfer characteristic matrix generating unit 68 may generate and output the spatial transfer characteristic matrix indicated by the selection result after the selection result of the spatial correction scheme is supplied from the spatial correction scheme selecting unit 67.

In step S50, the drive signal generating unit 69 calculates the speaker drive signal $D_{SP}(n_{tf},n_{sf})$ of the spatial frequency domain on the basis of the spatial transfer characteristic matrix $G'(n_{tf})$ supplied from the spatial transfer characteristic matrix generating unit 68 and the spatial frequency spectrum $S_{SP}(n_{tf},n_{sf})$ supplied from the decoding unit 66.

For example, the drive signal generating unit 69 calculates the speaker drive signal $D_{SP}(n_{tf},n_{sf})$ by performing the calculation of Formula (10) and supplies it to the spatial frequency synthesizing unit 70.

In step S51, the spatial frequency synthesizing unit 70 performs the spatial frequency synthesis on the speaker drive signal $D_{SP}(n_{tf},n_{sf})$ supplied from the drive signal generating unit 69, and supplies the time frequency spectrum $D(l,n_{tf})$ obtained as a result to the time frequency synthesizing unit 71. For example, in step S51, the calculation of Formula (11) is performed.

In step S52, the time frequency synthesizing unit 71 performs the time frequency synthesis on the time frequency spectrum $D(l,n_{tf})$ supplied from the spatial frequency synthesizing unit 70, and supplies the speaker drive signal $d(l,n_d)$ obtained as a result to the linear speaker array 22. For example, in step S52, the calculation of Formula (12) is performed.

In step S53, the linear speaker array 22 reproduces the sound on the basis of the speaker drive signal $d(l,n_d)$ supplied from the time frequency synthesizing unit 71. Accordingly, the acoustic field of the content, that is, the sound collection space is reproduced.

If the acoustic field of the sound collection space is reproduced in the reproduction space, the acoustic field reproduction process ends.

As described above, the spatial correction controller 51 selects the spatial correction scheme for correcting the spatial transfer characteristic on the basis of the spatial correction information flg, and performs the spatial correction process in accordance with the selection result. Accordingly, it is possible to reproduce the acoustic field more appropriately in accordance with the content.

In other words, if the spatial correction scheme is selected on the basis of the spatial correction information flg, it is possible to appropriately allocate the operation resources of the receiver 12 to the spatial correction process and other processes such as the sound quality improvement process in accordance with the content, the operation capability of the receiver 12, the reproduction environment such as the number of speakers of the linear speaker array 22, or the like. Accordingly, it is possible to realize the optimal acoustic field reproduction in which the spatial reproducibility or the sound quality reproducibility is emphasized.

<Description of Spatial Correction Scheme Selection Process>

Figure 8:
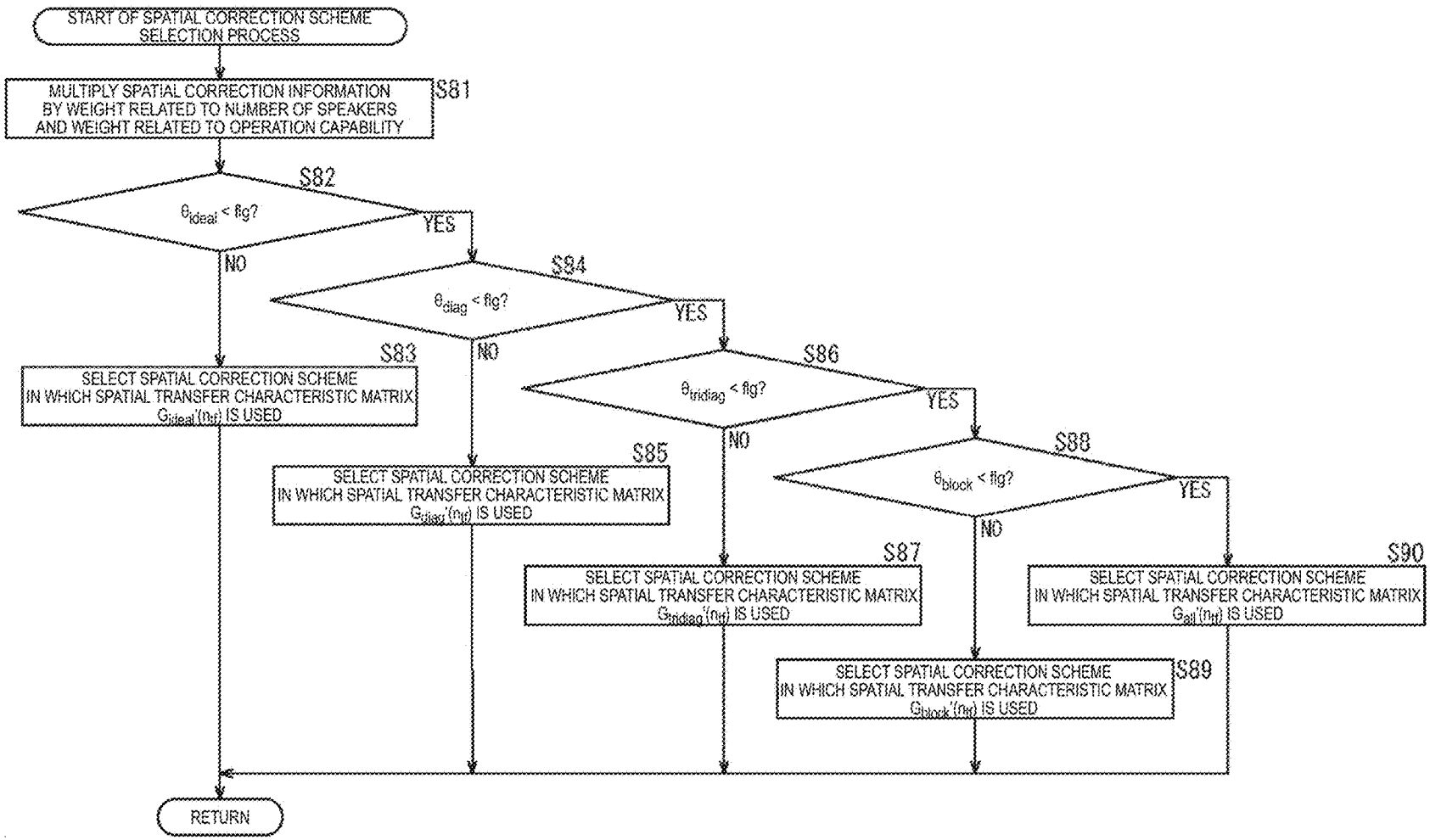
FIG. 8 is a flowchart for describing a spatial correction scheme selection process.

Next, the spatial correction scheme selection process corresponding to the process of step S48 in FIG. 7 will be described with reference to a flowchart of FIG. 8.

In step S81, the spatial correction scheme selecting unit 67 corrects the spatial correction information flg by multiplying the spatial correction information flg supplied from the decoding unit 66 by the weight $W_{sp}$ related to the number of speakers and the weight $W_{power}$ related to the operation capability.

In step S82, the spatial correction scheme selecting unit 67 compares the spatial correction information flg corrected in the process of step S81 with the threshold value $\theta_{ideal}$ and determines whether or not the threshold value $\theta_{ideal}$ is smaller than the spatial correction information flg, that is, whether not the spatial correction information flg is larger than the threshold value $\theta_{ideal}$.

If the threshold value $\theta_{ideal}$ is not smaller than the spatial correction information flg in step S82, that is, if the spatial correction information flg is smaller than or equal to the threshold value $\theta_{ideal}$, the process proceeds to step S83.

In step S83, the spatial correction scheme selecting unit 67 selects the spatial correction scheme in which the spatial transfer characteristic matrix $G_{ideal}'(n_{tf})$ is used for the spatial correction process.

In other words, the spatial correction scheme selecting unit 67 selects the spatial transfer characteristic matrix $G_{ideal}'n_{tf})$ as the spatial transfer characteristic matrix $G'(n_{tf})$, and supplies information indicating the selection result to the spatial transfer characteristic matrix generating unit 68. If the spatial transfer characteristic matrix $G'(n_{tf})$ is selected, the spatial correction scheme selection process ends, and thereafter, the process proceeds to step S49 in FIG. 7.

For example, in a case in which the priority indicated by the spatial correction information flg is low, and the spatial reproducibility is less emphasized, when the operation resources are concentrated on other processes rather than the spatial correction process, it is possible to realize the more optimal acoustic field reproduction. In this regard, in a case in which the spatial correction information flg is smaller than or equal to the threshold value $\theta_{ideal}$, the spatial correction scheme selecting unit 67 selects the spatial correction scheme with the smallest operation amount so that operation resources are allocated to other processes.

In the spatial correction scheme selecting unit 67, the spatial correction information flg is corrected on the basis of the weight $W_{SP}$ related to the number of speakers. For this reason, for example, when the number of speakers are large, and the energy of the spatial transfer characteristic matrix $G_{measure}'(n_{tf})$ is concentrated on the diagonal components, the sufficiently high spatial reproducibility can be obtained even in the spatial correction process with the small operation amount, and thus the spatial correction information flg is corrected to be decreased. Accordingly, it is possible to obtain the sufficient spatial reproducibility with a small operation amount, and it is possible to realize the more appropriate acoustic field reproduction.

Similarly, in the spatial correction scheme selecting unit 67, the spatial correction information flg is corrected on the basis of the weight $W_{power}$ related to the operation capability. For this reason, for example, when the operation capability of the receiver 12 is high, and it is possible to allocate sufficient operation resources to the spatial correction process, the spatial correction information flg is corrected to be increased. Accordingly, it is possible to secure the sufficient operation resources for the correction space process and realize the more appropriate acoustic field reproduction.

In a case in which it is determined in step S82 that the threshold value $\theta_{ideal}$ is smaller than the spatial correction information flg, that is, the spatial correction information flg is larger than the threshold value $\theta_{ideal}$, the process proceeds to step S84.

In step S84, the spatial correction scheme selecting unit 67 compares the spatial correction information flg corrected in the process of step S81 with the threshold value $\theta_{diag}$ and determines whether or not the threshold value $\theta_{diag}$ is smaller than the spatial correction information flg, that is, whether or not the spatial correction information flg is larger than the threshold value $\theta_{diag}$.

In a case in which it is determined in step S84 that the threshold value $\theta_{diag}$ is not smaller than the spatial correction information flg, that is, the spatial correction information flg is smaller than or equal to the threshold value $\theta_{diag}$, the process proceeds to step S85.

In step S85, the spatial correction scheme selecting unit 67 selects the spatial correction scheme in which the spatial transfer characteristic matrix $G_{diag}'(n_{tf})$ is used for the spatial correction process.

In other words, the spatial correction scheme selecting unit 67 selects the spatial transfer characteristic matrix $G_{diag}'(n_{tf})$ as the spatial transfer characteristic matrix $G'(n_{tf})$, and supplies information indicating the selection result to the spatial transfer characteristic matrix generating unit 68. If the spatial transfer characteristic matrix $G'(n_{tf})$ is selected, the spatial correction scheme selection process ends, and thereafter, the process proceeds to step S49 in FIG. 7.

On the other hand, if it is determined in step S84 that the threshold value $\theta_{diag}$ is smaller than the spatial correction information flg, that is, the spatial correction information flg is larger than the threshold value $\theta_{diag}$, the process proceeds to step S86.

In step S86, the spatial correction scheme selecting unit 67 compares the spatial correction information flg corrected in the process of step S81 with the threshold value $\theta_{tridiag}$ and determines whether or not the threshold value $\theta_{tridiag}$ is smaller than the spatial correction information flg, that is, whether or not the spatial correction information flg is larger than the threshold value $\theta_{tridiag}$.

In a case in which it is determined in step S86 that the threshold value $\theta_{tridiag}$ is not smaller than the spatial correction information flg, that is, the spatial correction information flg is smaller than or equal to the threshold value $\theta_{tridiag}$, the process proceeds to step S87.

In step S87, the spatial correction scheme selecting unit 67 selects the spatial correction scheme in which the spatial transfer characteristic matrix $G_{tridiag}'(n_{tf})$ is used for the spatial correction process.

In other words, the spatial correction scheme selecting unit 67 selects the spatial transfer characteristic matrix $G_{tridiag}'(n_{tf})$ as the spatial transfer characteristic matrix $G'(n_{tf})$, and supplies information indicating the selection result to the spatial transfer characteristic matrix generating unit 68. If the spatial transfer characteristic matrix $G'(n_{tf})$ is selected, the spatial correction scheme selection process ends, and thereafter the process proceeds to step S49 in FIG. 7.

On the other hand, if it is determined in step S86 that the threshold value $\theta_{tridiag}$ is smaller than the spatial correction information flg, that is, the spatial correction information flg is larger than the threshold value $\theta_{tridiag}$, the process proceeds to step S88.

In step S88, the spatial correction scheme selecting unit 67 compares the spatial correction information flg corrected in the process of step S81 with the threshold value $\theta_{block}$ and determines whether or not the threshold value $\theta_{block}$ is smaller than the spatial correction information flg, that is, whether or not the spatial correction information flg is larger than the threshold value $\theta_{block}$.

In a case in which it is determined in step S88 that the threshold value $\theta_{block}$ is not smaller than the spatial correction information flg, that is, the spatial correction information flg is smaller than or equal to the threshold value $\theta_{block}$, the process proceeds to step S89.

In step S89, the spatial correction scheme selecting unit 67 selects the spatial correction scheme in which the spatial transfer characteristic matrix $G_{block}'(n_{tf})$ is used for the spatial correction process.

In other words, the spatial correction scheme selecting unit 67 selects the spatial transfer characteristic matrix $G_{block}'(n_{tf})$ as the spatial transfer characteristic matrix $G'(n_{tf})$ and supplies the information indicating the selection result to the spatial transfer characteristic matrix generating unit 68. If the spatial transfer characteristic matrix $G'(n_{tf})$ is selected, the spatial correction scheme selection process ends, and thereafter, the process proceeds to step S49 in FIG. 7.

On the other hand, if it is determined in step S88 that the threshold value $\theta_{block}$ is smaller than the spatial correction information flg, that is, the spatial correction information flg is larger than the threshold value $\theta_{block}$, the process proceeds to step S90.

In step S90, the spatial correction scheme selecting unit 67 selects the spatial correction scheme in which the spatial transfer characteristic matrix $G_{a11}'(n_{tf})$ is used for the spatial correction process.

In other words, the spatial correction scheme selecting unit 67 selects the spatial transfer characteristic matrix $G_{all}'(n_{tf})$ as the spatial transfer characteristic matrix $G'(n_{tf})$ and supplies the information indicating the selection result to the spatial transfer characteristic matrix generating unit 68. If the spatial transfer characteristic matrix $G'(n_{tf})$ is selected, the spatial correction scheme selection process ends, and thereafter, the process proceeds to step S49 in FIG. 7.

As described above, the spatial correction controller 51 appropriately corrects the spatial correction information flg, and selects the spatial correction scheme by comparing the corrected spatial correction information flg with a predetermined threshold value. Accordingly, it is possible to perform the optimal the spatial correction process in view of the intention of the content creator, the reproduction environment of the content, the operation capability of the receiver 12, and the like. Accordingly, it is possible to realize the optimal acoustic field reproduction.

Incidentally, the above-described series of processes may be performed by hardware or may be performed by software. When the series of processes are performed by software, a program forming the software is installed into a computer. Examples of the computer include a computer that is incorporated in dedicated hardware and a general-purpose computer that can perform various types of function by installing various types of program.

Figure 9:
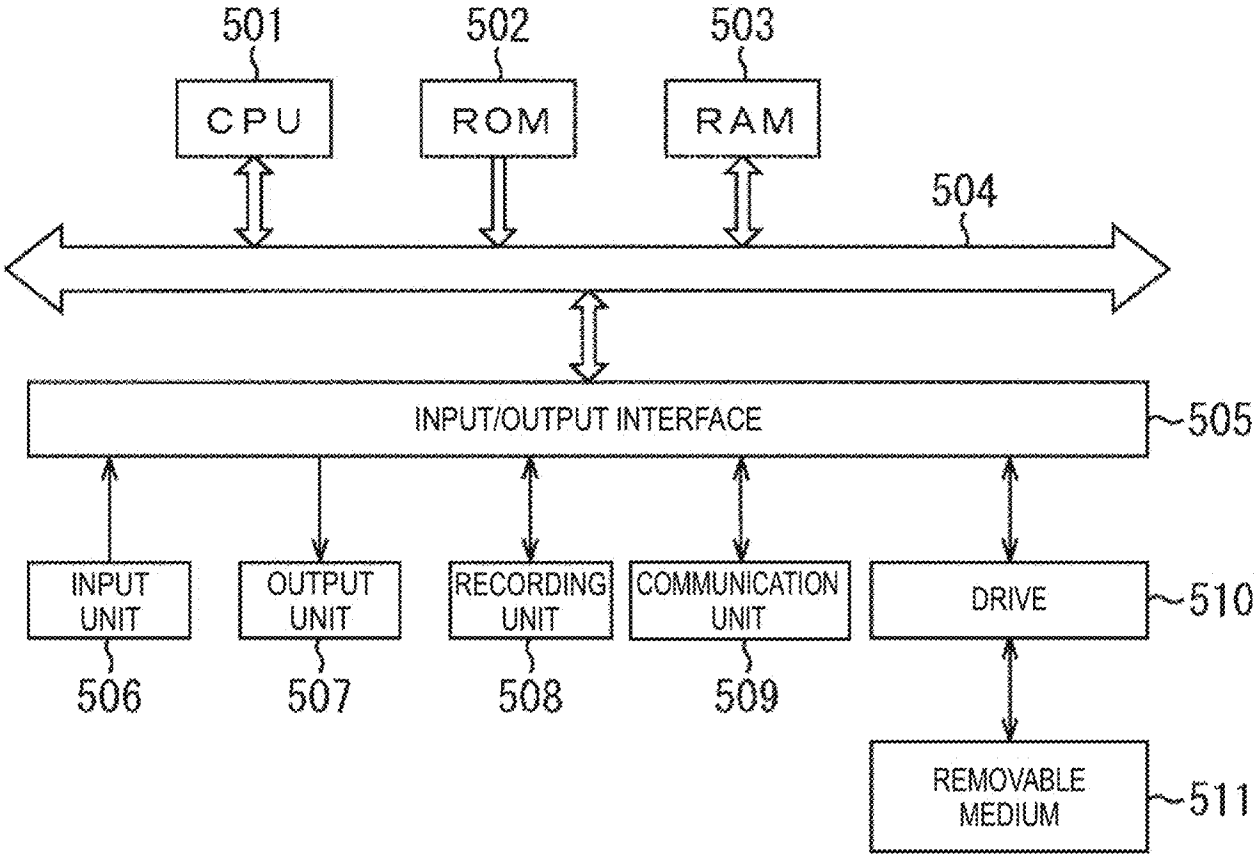
FIG. 9 is a diagram illustrating a configuration example of a computer.

FIG. 9 is a block diagram illustrating a configuration example of the hardware of a computer that performs the above-described series of processes with a program.

In the computer, a central processing unit (CPU) 501, read only memory (ROM) 502, and random access memory (RAM) 503 are mutually connected by a bus 504.

Further, an input/output interface 505 is connected to the bus 504. Connected to the input/output interface 505 are an input unit 506, an output unit 507, a recording unit 508, a communication unit 509, and a drive 510.

The input unit 506 includes a keyboard, a mouse, a microphone, an image sensor, and the like. The output unit 507 includes a display, a speaker, and the like. The recording unit 508 includes a hard disk, a non-volatile memory, and the like. The communication unit 509 includes a network interface, and the like. The drive 510 drives a removable recording medium 511 such as a magnetic disk, an optical disc, a magneto-optical disk, and a semiconductor memory.

In the computer configured as described above, the CPU 501 loads a program that is recorded, for example, in the recording unit 508 onto the RAM 503 via the input/output interface 505 and the bus 504, and executes the program, thereby performing the above-described series of processes.

For example, programs to be executed by the computer (CPU 501) can be recorded and provided in the removable recording medium 511, which is a packaged medium or the like. In addition, programs can be provided via a wired or wireless transmission medium such as a local area network, the Internet, and digital satellite broadcasting.

In the computer, by mounting the removable recording medium 511 onto the drive 510, programs can be installed into the recording unit 508 via the input/output interface 505. Programs can also be received by the communication unit 509 via a wired or wireless transmission medium, and installed into the recording unit 508. In addition, programs can be installed in advance into the ROM 502 or the recording unit 508.

Note that a program executed by the computer may be a program in which processes are chronologically carried out in a time series in the order described herein or may be a program in which processes are carried out in parallel or at necessary timing, such as when the processes are called.

In addition, embodiments of the present disclosure are not limited to the above-described embodiments, and various alterations may occur insofar as they are within the scope of the present disclosure.

For example, the present technology can adopt a configuration of cloud computing, in which a plurality of devices share a single function via a network and perform processes in collaboration.

Furthermore, each step in the above-described flowcharts can be executed by a single device or shared and executed by a plurality of devices.

In addition, when a single step includes a plurality of processes, the plurality of processes included in the single step can be executed by a single device or shared and executed by a plurality of devices.

The advantageous effects described herein are not limited, but merely examples. Any other advantageous effects may also be attained.

Additionally, the present technology may also be configured as below.

(1)

A signal processing device including:

an acquiring unit configured to acquire a multichannel audio signal obtained by performing sound collection through a microphone array;

a spatial correction scheme selecting unit configured to select one spatial correction scheme from among a plurality of spatial correction schemes for correcting a spatial transfer characteristic on the basis of spatial correction information; and a spatial correction processing unit configured to perform a spatial correction process on the audio signal on the basis of a spatial transfer characteristic matrix of the selected spatial correction scheme.

(2)

The signal processing device according to (1), in which the spatial correction information is information indicating a priority of the spatial correction process.

(3)

The signal processing device according to (1) or (2), in which the spatial correction scheme selecting unit selects the spatial correction scheme on the basis of the spatial correction information and a number of speakers constituting a speaker array that outputs a sound on the basis of the audio signal.

(4)

The signal processing device according to any one of (1) to (3), in which the spatial correction scheme selecting unit selects the spatial correction scheme on the basis of the spatial correction information and an operation capability of the signal processing device.

(5)

The signal processing device according to any one of (1) to (4), in which the plurality of spatial correction schemes differ from each other in an operation amount of the spatial correction process.

(6)

The signal processing device according to any one of (1) to (5), in which the spatial transfer characteristic matrix is obtained by extracting a part or a whole of a matrix indicating a spatial transfer characteristic of a space in which a sound based on the audio signal is reproduced.

(7)

The signal processing device according to (6), in which the spatial transfer characteristic matrices of the plurality of spatial correction schemes include at least any one of the spatial transfer characteristic matrix obtained by extracting at least only a diagonal component of the matrix, the spatial transfer characteristic matrix obtained by extracting only a triple diagonal component of the matrix, the spatial transfer characteristic matrix obtained by extracting only a specific block of the matrix, and the spatial transfer characteristic matrix which is the matrix.

(8)

The signal processing device according to any one of (1) to (7), in which the spatial correction information is set in the audio signal in a predetermined time unit.

(9)

The signal processing device according to any one of (1) to (8), in which the acquiring unit acquires the spatial correction information together with the audio signal.

(10)

A signal processing method including the steps of:

acquiring a multichannel audio signal obtained by performing sound collection through a microphone array;

selecting one spatial correction scheme from among a plurality of spatial correction schemes for correcting a spatial transfer characteristic on the basis of spatial correction information; and performing a spatial correction process on the audio signal on the basis of a spatial transfer characteristic matrix of the selected spatial correction scheme.

(11)

A program causing a computer to execute a process including the steps of:

acquiring a multichannel audio signal obtained by performing sound collection through a microphone array;

selecting one spatial correction scheme from among a plurality of spatial correction schemes for correcting a spatial transfer characteristic on the basis of spatial correction information; and performing a spatial correction process on the audio signal on the basis of a spatial transfer characteristic matrix of the selected spatial correction scheme.

(12)

A signal processing device including:

an acquiring unit configured to acquire spatial correction information for selecting a scheme of a spatial correction process of correcting a spatial transfer characteristic, the spatial correction process being performed on a multichannel audio signal obtained by performing sound collection through a microphone array; and an output unit configured to output the audio signal and the spatial correction information.

(13)

The signal processing device according to (12), in which the spatial correction information is information indicating a priority of the spatial correction process.

(14)

The signal processing device according to (12) or (13), in which the spatial correction information is set in the audio signal in a predetermined time unit.

(15)

A signal processing method including the steps of:

acquiring spatial correction information for selecting a scheme of a spatial correction process of correcting a spatial transfer characteristic, the spatial correction process being performed on a multichannel audio signal obtained by performing sound collection through a microphone array; and outputting the audio signal and the spatial correction information.

(16)

A program causing a computer to execute a process including the steps of:

acquiring spatial correction information for selecting a scheme of a spatial correction process of correcting a spatial transfer characteristic, the spatial correction process being performed on a multichannel audio signal obtained by performing sound collection through a microphone array; and outputting the audio signal and the spatial correction information.

REFERENCE SIGNS LIST

11 transmitter
12 receiver
21 linear microphone array
22 linear speaker array
61 time frequency analyzing unit
62 spatial frequency analyzing unit
63 encoding unit
64 communication unit
65 communication unit
66 decoding unit
67 spatial correction scheme selecting unit
68 spatial transfer characteristic matrix generating unit
69 drive signal generating unit
70 spatial frequency synthesizing unit
71 time frequency synthesizing unit

The invention claimed is:

1. A signal processing device comprising:

a computer including a processing device and a memory device storing instructions that, when executed by the processing device, cause the processing device to:

receive a multiplexed signal, including a multichannel audio signal, from a transmitter based on the transmitter performing sound collection through a microphone array in a sound collection space;

select one spatial correction scheme from among a plurality of spatial correction schemes for correcting a spatial transfer characteristic on the basis of spatial correction information; and perform a spatial correction process on the multichannel audio signal on the basis of a spatial transfer characteristic matrix of the selected spatial correction scheme to provide a spatially corrected audio signal and to output the spatially corrected audio signal to a speaker array in a reproduction space different from the sound collection space, wherein the spatial correction information is information indicating a priority of the spatial correction process.

2. The signal processing device according to claim 1, wherein the spatial correction scheme is selected on the basis of the spatial correction information and a number of speakers constituting a speaker array that outputs a sound on the basis of the multichannel audio signal.

3. The signal processing device according to claim 1, wherein the spatial correction scheme is selected on the basis of the spatial correction information and an operation capability of the signal processing device.

4. The signal processing device according to claim 1, wherein the plurality of spatial correction schemes differ from each other in an operation amount of the spatial correction process.

5. The signal processing device according to claim 1, wherein the spatial transfer characteristic matrix is obtained by extracting a part or a whole of a matrix indicating a spatial transfer characteristic of a space in which a sound based on the multichannel audio signal is reproduced.

6. The signal processing device according to claim 5, wherein the spatial transfer characteristic matrices of the plurality of spatial correction schemes include at least any one of the spatial transfer characteristic matrix obtained by extracting at least only a diagonal component of the matrix indicating a spatial transfer characteristic of a space in which a sound based on the audio signal is reproduced, the spatial transfer characteristic matrix obtained by extracting only a triple diagonal component of the matrix indicating a spatial transfer characteristic of a space in which a sound based on the audio signal is reproduced, the spatial transfer characteristic matrix obtained by extracting only a specific block of the matrix indicating a spatial transfer characteristic of a space in which a sound based on the audio signal is reproduced, and the spatial transfer characteristic matrix which is obtained by extracting the whole of the matrix indicating a spatial transfer characteristic of a space in which a sound based on the audio signal is reproduced.

7. The signal processing device according to claim 1, wherein the spatial correction information is set in the multiplexed signal in a predetermined time unit.

8. The signal processing device according to claim 1, wherein the spatial correction information is received together with the multichannel audio signal.

9. A signal processing method comprising:

receive a multiplexed signal, including a multichannel audio signal, from a transmitter based on the transmitter performing sound collection through a microphone array in a sound collection space;

selecting one spatial correction scheme from among a plurality of spatial correction schemes for correcting a spatial transfer characteristic on the basis of spatial correction information; and performing a spatial correction process on the multichannel audio signal on the basis of a spatial transfer characteristic matrix of the selected spatial correction scheme to provide a spatially corrected audio signal and outputting the spatially corrected audio signal to a speaker array in a reproduction space different from the sound collection space, wherein the spatial correction information is information indicating a priority of the spatial correction process.

10. A non-transitory computer-readable medium storing instructions that, when executed by a processing device, perform a process comprising:

receiving a multiplexed signal, including a multichannel audio signal, from a transmitter based on the transmitter performing sound collection through a microphone array in a sound collection space;

selecting one spatial correction scheme from among a plurality of spatial correction schemes for correcting a spatial transfer characteristic on the basis of spatial correction information; and performing a spatial correction process on the multichannel audio signal on the basis of a spatial transfer characteristic matrix of the selected spatial correction scheme to provide a spatially corrected audio signal and outputting the spatially corrected audio signal to a speaker array in a reproduction space different from the sound collection space, wherein the spatial correction information is information indicating a priority of the spatial correction process.

11. A signal processing device comprising:

a computer including a processing device and a memory device storing instructions that, when executed by the processing device, cause the processing device to:

acquire spatial correction information for selecting a scheme of a spatial correction process of correcting a spatial transfer characteristic, the spatial correction process being performed on a multichannel audio signal obtained by, performing sound collection through a microphone array in a sound collection space; and including the multichannel audio signal wherein the receiver performs a spatial correction process on the multichannel audio signal on the basis of a spatial transfer characteristic matrix of the selected spatial correction scheme and outputs the spatially corrected audio signal to a speaker array in a reproduction space different from the sound collection space wherein the spatial correction information is information indicating a priority of the spatial correction process.

12. The signal processing device according to claim 11, wherein the spatial correction information is set in the multiplexed signal in a predetermined time unit.

13. A signal processing method comprising:

acquiring spatial correction information for selecting a scheme of a spatial correction process of correcting a spatial transfer characteristic, the spatial correction process being performed on a multichannel audio signal obtained by performing sound collection through a microphone array in a sound collection space; and outputting a multiplexed signal including the multichannel audio signal and the spatial correction information to a receiver, wherein the receiver performs a spatial correction process on the multichannel audio signal on the basis of a spatial transfer characteristic matrix of the selected spatial correction scheme and outputs the spatially corrected audio signal to a speaker array in a reproduction space different from the sound collection space, wherein the spatial correction information is information indicating a priority of the spatial correction process.

14. A non-transitory computer-readable medium storing instructions that, when executed by a processing device, perform a process comprising:

acquiring spatial correction information for selecting a scheme of a spatial correction process of correcting a spatial transfer characteristic, the spatial correction process being performed on a multichannel audio signal obtained by performing sound collection through a microphone array in a sound collection space; and outputting a multiplexed signal including the multichannel audio signal and the spatial correction information to a receiver, wherein the receiver performs a spatial correction process on the multichannel audio signal on the basis of a spatial transfer characteristic matrix of the selected spatial correction scheme and outputs the spatially corrected audio signal to a speaker array in a reproduction space different from the sound collection space, wherein the spatial correction information is information indicating a priority of the spatial correction process.

* * * * *